US012687311B2

(12) United States Patent
Aoki et al.

(10) Patent No.: US 12,687,311 B2
(45) Date of Patent: Jul. 21, 2026

(54) AIR CONDITIONER

(71) Applicant: FUJITSU GENERAL LIMITED, Kanagawa (JP)

(72) Inventors: Hironori Aoki, Kanagawa (JP); Tomoaki Niwa, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 195 days.

(21) Appl. No.: 17/908,123

(22) PCT Filed: Mar. 15, 2021

(86) PCT No.: PCT/JP2021/010436
§ 371 (c)(1),
(2) Date: Aug. 30, 2022

(87) PCT Pub. No.: WO2021/187440
PCT Pub. Date: Sep. 23, 2021

(65) Prior Publication Data

US 2023/0114621 A1 Apr. 13, 2023

(30) Foreign Application Priority Data

Mar. 16, 2020 (JP) ..... 2020-045722

(51) Int. Cl.
*F24F 1/56* (2011.01)
*F24F 13/22* (2006.01)

(52) U.S. Cl.
CPC ..... *F24F 1/56* (2013.01); *F24F 13/222* (2013.01)

(58) Field of Classification Search
CPC ..... F24F 1/56; F24F 1/62; F24F 1/027; F24F 1/36; F24F 1/06; F24F 1/12; F24F 1/031;
(Continued)

(56) References Cited

U.S. PATENT DOCUMENTS 2,362,698 A * 11/1944 Hull ..... F24F 1/60 62/262
2,472,792 A * 6/1949 Cohler ..... F24F 1/027 62/448

(Continued)

FOREIGN PATENT DOCUMENTS

CA 2660234 A1 * 9/2010 ..... F24F 1/0007
CN 104296359 A * 1/2015 ..... F24F 13/222

(Continued)

OTHER PUBLICATIONS

CN-107101414-A English Translation (Year: 2017).*

(Continued)

*Primary Examiner* — Frantz F Jules
*Assistant Examiner* — Devon Moore
(74) *Attorney, Agent, or Firm* — Greenblum & Bernstein, P.L.C.

(57) ABSTRACT

An air conditioner capable of satisfactorily preventing noise from entering an indoor space includes: an indoor unit that is fixed to a wall surface of an indoor space and houses an indoor heat exchanger; and an outdoor unit that houses an outdoor heat exchanger connected to a refrigerant circuit that includes the indoor heat exchanger. The outdoor unit includes an outside casing that is fitted into an opening formed in a building wall partitioning an outdoor space and the indoor space from each other and defines an internal space that is open to the outdoor space and isolated from the indoor space by being surrounded by a sound insulation wall, and an inside casing that is disposed in the internal space and houses the outdoor heat exchanger.

15 Claims, 16 Drawing Sheets

(58) Field of Classification Search
CPC ..... F24F 13/222; F24F 13/224; F24F 13/24; F24F 2013/242; F24F 11/42; F24F 1/02; F24F 1/0314; F24F 13/20; F24F 11/41; F24F 2203/1012; F24F 1/40; F24F 2013/247; F25B 2500/12; F25B 2500/13
See application file for complete search history.

(56) References Cited

U.S. PATENT DOCUMENTS

| | | | | |
|---|---|---|---|---|
| 2,979,918 | A * | 4/1961 | Atchison | F24F 13/224 62/262 |
| 4,308,905 | A * | 1/1982 | Gallagher | F24F 13/20 150/165 |
| 4,332,114 | A * | 6/1982 | Goebel | F24F 13/20 182/47 |
| 4,534,179 | A * | 8/1985 | Stocking | F24F 1/022 62/305 |
| 4,637,223 | A | 1/1987 | Hosoya et al. | |
| 6,168,248 | B1 * | 1/2001 | Timmons | F24F 1/027 312/264 |
| 8,522,567 | B2 * | 9/2013 | Kim | F24F 11/41 62/154 |
| 10,352,594 | B2 | 7/2019 | D'Souza et al. | |
| 11,333,394 | B2 * | 5/2022 | Bush | B08B 3/02 |
| 11,796,193 | B2 * | 10/2023 | Kim | F24F 1/027 |
| 2009/0145153 | A1 * | 6/2009 | Moynihan | F24F 1/62 62/259.1 |
| 2011/0239678 | A1 * | 10/2011 | Yasuda | F16L 15/006 285/334.5 |
| 2016/0209055 | A1 * | 7/2016 | Gedcke | F24F 1/031 |
| 2020/0064017 | A1 * | 2/2020 | Jewell | F24F 13/20 |

FOREIGN PATENT DOCUMENTS

| | | | | |
|---|---|---|---|---|
| CN | 106907798 | A * | 6/2017 | E04B 1/98 |
| CN | 107101414 | A * | 8/2017 | |
| CN | 108426065 | A * | 8/2018 | |
| JP | 64-41023 | U1 | 3/1989 | |
| JP | 4-55641 | A | 2/1992 | |
| JP | 2008082684 | A * | 4/2008 | F24F 13/222 |
| WO | WO-02053975 | A1 * | 7/2002 | F24F 1/46 |
| WO | WO-2019146003 | A1 * | 8/2019 | F24D 17/02 |

OTHER PUBLICATIONS

CN-108426065-A English Translation (Year: 2018).*
CN-104296359-A English Translation (Year: 2015).*
WO-2019146003-A1 English Translation (Year: 2019).*
JP-2008082684-A English Translation (Year: 2008).*
CN-106907798-A English Translation (Year: 2017).*
International Search Report issued in International Bureau of WIPO Patent Application No. PCT/JP2021/010436, Dated May 25, 2021, along with an English translation thereof.

* cited by examiner (A)

(B)

AIR CONDITIONER

TECHNICAL FIELD

The present invention relates to an air conditioner that includes an indoor unit that is fixed to a wall surface of an indoor space and houses an indoor heat exchanger and an outdoor unit that houses an outdoor heat exchanger connected to a refrigerant circuit that includes the indoor heat exchanger.

BACKGROUND ART

Patent Literature 1 and Patent Literature 2 disclose an air conditioner called PTAC (Packaged Terminal Air Conditioner) including a casing that is fitted into an opening formed in a wall partitioning an outdoor space and an indoor space from each other and houses a refrigerant circuit including an indoor heat exchanger and an outdoor heat exchanger. The inside of the casing is partitioned by a partition wall (bulk head) into an outdoor side space that is open to the outdoor space and an indoor side space that is open to the indoor space. The partition wall makes it possible to prevent air from moving between the outdoor side space and the indoor side space in the casing. In this way, air conditioning is achieved.

CITATION LIST

Patent Literature

Patent Literature 1: U.S. Pat. No. 10,352,594
Patent Literature 2: U.S. Pat. No. 4,637,223

DISCLOSURE OF INVENTION

Technical Problem

In Patent Literature 1, a partition wall is installed on a bottom plate tray. The bottom plate tray is disposed in a casing along a bottom plate of the casing. The partition wall is desired to be as thin as possible so as not to interfere with the disposition of internal parts. Therefore, since heat exchange of the air on the outdoor heat exchanger side of the casing and the air on the indoor heat exchanger side of the casing is performed via the partition wall, the partition wall cannot provide sufficient thermal insulation. Further, since the partition wall is desired to be as thin as possible, a sound insulation structure cannot be adopted. Noise in the outdoor space leaks from the outdoor side space into the indoor side space.

In Patent Literature 2, a partition wall is disposed on a drain pan for guiding drain water generated in an indoor side heat exchanger into the outdoor side. A gap is formed between the drain pan and the partition wall. Therefore, noise in the outdoor space leaks from the outdoor side space into the indoor side space.

It is an object of the present invention to provide an air conditioner that includes a casing fitted into an opening formed in a building wall partitioning an outdoor space and an indoor space from each other and is capable of satisfactorily preventing noise from entering the indoor space.

Solution to Problem

In accordance with an aspect of the present invention, there is provided an air conditioner including: an indoor unit that is fixed to a wall surface of an indoor space and houses an indoor heat exchanger; and an outdoor unit that houses an outdoor heat exchanger connected to a refrigerant circuit that includes the indoor heat exchanger, in which the outdoor unit includes an outside casing that is fitted into an opening formed in a building wall partitioning an outdoor space and the indoor space and defines an internal space that is open to the outdoor space, is surrounded by a sound insulation wall and is isolated from the indoor space, and an inside casing that is disposed in the internal space and houses the outdoor heat exchanger.

The outdoor unit is combined with the indoor unit to provide a separate type air conditioner. When the outside casing is fitted into the opening of the building wall, the internal space of the outside casing is separated from the indoor space by the sound insulation wall. It is possible to prevent air from flowing from the internal space to the indoor space. The outdoor unit exchanges heat between the outside air entering the internal space and a refrigerant. The efficiency of heat exchange can be satisfactorily achieved. Here, noise in the outdoor space is blocked by the sound insulation wall. It is possible to satisfactorily prevent noise from entering. The quietness of the indoor space can be satisfactorily achieved.

The outside casing may include a wall body and a front panel, the wall body including a side wall extending along a virtual plane orthogonal to a wall surface of the building wall and defines a storage port opening toward the indoor space, the front panel is joined to the wall body and closes the storage port. The inside casing may include a suction port and a blower port, the suction port is open to the outdoor space and the blower port blows out air after heat exchange toward the side wall.

The opening of the building wall has the dimensions determined for PTAC. Here, since it may dispose only the outdoor unit in the opening of the building wall, a large space can be provided between the blower port and the side wall of the outside casing. In this way, the air after heat exchange can be efficiently discharged from the blower port toward the outdoor space. The flow rate of air passing through the outdoor heat exchanger can be increased. It is possible to increase the efficiency of heat exchange in the outdoor unit.

The outside casing may include a second side wall that houses the inside casing between the second side wall and the side wall, the wall body including the second side wall. At this time, the refrigerant circuit may include a switching valve, the switching valve is connected to the outdoor heat exchanger, protrudes from a side plate facing the second side wall in the inside casing, and switches opening and closing of a connection port on the basis of rotation of a screw whose rotation axis is an axis line set perpendicular to a plate surface of the side plate.

When installing the air conditioner, a refrigerant pipe is connected to the connection port of the switching valve, and then, the connection port of the switching valve is opened. In this way, a refrigerant is capable of flowing in the refrigerant pipe. When opening the switching valve, the screw is turned with the axis line as the rotation axis. Here, since it may dispose only the outdoor unit in the opening of the building wall, a sufficient space can be provided between the second side wall and the side plate of the inside casing. In the internal space of the outside casing, for example, the work of driving the screw around the axis line with a wrench can be satisfactorily achieved.

The outside casing may include a wall body and a front panel, the wall body including a side wall extending along a virtual plane orthogonal to a wall surface of the building wall and defines a storage port opening toward the indoor space, the front panel is joined to the wall body and closes the storage port. At this time, the refrigerant circuit may include a switching valve and an auxiliary refrigerant pipe, the switching valve is connected to the outdoor heat exchanger, protrudes from a side plate facing the side wall in the inside casing, and forms a connection port having an axis line set in parallel to a plate surface of the side plate, the auxiliary refrigerant pipe is connected to the connection port in accordance with tightening of a flare nut whose rotation axis is the axis line and is drawn from the outside casing to the indoor space on a side of the indoor space than an edge of the side wall on the side of the indoor space.

When installing the air conditioner, the auxiliary refrigerant pipe is connected to the connection port of the switching valve. A flare nut is tightened around the axis line with a wrench. The connecting can be liquid-tightly established. After connecting the auxiliary refrigerant pipe, the inside casing is housed in the outside casing from the storage port. At this time, the interference between the auxiliary refrigerant pipe and the side wall of the outside casing can be avoided. In this way, the work of the wrench is performed prior to the storage in the outside casing, so that a sufficient work space can be provided. When connecting the auxiliary refrigerant pipe, efficient work can be achieved.

The outside casing may include a bottom plate that is supported so as to be slidable with respect to the wall body in parallel to the side wall and supports the inside casing from below. When storing the inside casing, the bottom plate is capable of sliding relative to the wall body of the outside casing. Therefore, the work of storing the inside casing can be easily achieved. The efficient work can be achieved.

The edge of the side wall on a side of the indoor space may include a joining edge and an escape edge, the joining edge is partitioned in a direction perpendicular to a floor surface of the indoor space and is fitted into the front panel, the escape edge is recessed from the joining edge toward a side of the outdoor space and accepts entry of the auxiliary refrigerant pipe. Since the escape edge is formed on the side wall of the outside casing when disposing the auxiliary refrigerant pipe, it is possible to prevent the front panel from protruding toward the side of the indoor space when disposing the auxiliary refrigerant pipe. It is possible to suppress the protrusion of the outdoor unit from the building wall as much as possible. In addition, it is possible to satisfactorily maintain the design of the front panel.

The outside casing may include right and left side walls, a first top wall, and a second top wall, the right and left side walls extends along a virtual plane orthogonal to a wall surface of the building wall, the first top wall extends from an end of the side wall on a side of the outdoor space toward a side of the indoor space and closes the internal space sandwiched by the right and left side walls from above, the second top wall extends from the first top wall toward a side of the indoor space to an end of the side wall on a side of the indoor space and closes the internal space from above so as to be openable and closable. The first top wall is embedded in the building wall to form the sound insulation wall in the building wall. In the case where the second top wall is disposed in the indoor space, a path for accessing the internal space in accordance with opening and closing of the second top wall can be provided. Even after installing the air conditioner, favorable maintenance work can be achieved.

A heater may be disposed between the outside casing and the inside casing. By disposing the heater between the outside casing and the inside casing, defrost-water is prevented from freezing in the outside casing. Further, with this disposition, a floor plate of the inside casing or the bottom plate of the outside casing where frost (ice) grows during the heating operation is efficiently heated by the heater, the increase in the electric power input to the heater is suppressed, and the wasteful consumption of the electric power of the heater is suppressed.

The outside casing may include a drain pan for storing defrost-water generated when frost adhered to the outdoor heat exchanger is melted and a pump for discharging the defrost-water to an outside of the outside casing. The defrost-water collected in the drain pan is drained by the pump and the defrost-water is prevented from leaking from the drain pan.

At least part of the heater may be housed in the drain pan. The frost (ice) frozen in the drain pan is efficiently melted by the heater.

A first control unit that controls the heater may be provided in the inside casing, and the first control unit may energize the heater when a second control unit receives a signal indicating a heating operation including a defrosting operation from the second control unit provided in the indoor unit. By performing control of energizing the heater by the first control unit included in the air conditioner, it is possible to energize the heater in synchronization with the heating operation.

The heater may be controlled by the first control unit to start energization in accordance with outside temperature. By setting this temperature range, the defrost-water is prevented from freezing and unnecessary consumption of electric power is suppressed.

The air conditioner may further include the sound insulation material on at least an outside of the outside casing corresponding to a position where the heater is disposed. By providing the sound insulation material, the sound of a compressor and the sound of drainage of the defrost-water are prevented from leaking from the inside casing or the outside casing. Further, even in the case where cold outside air is sucked into the inside casing, thermal insulation is performed regarding the temperature of the outside air by the thermal insulation properties of the sound insulation material and the indoor temperature is less affected by the outside temperature.

A plurality of holes for dropping the defrost-water into the drain pan may be provided in the bottom plate of the inside casing, and part of the heater may be housed in the drain pan along a direction in which the plurality of holes is lined up. A drain for draining the defrost-water to an outside of the outside casing may be provided in the drain pan, and another part of the heater different from the part may be housed in the drain pan so as to be adjacent to the drain. With such disposition, the defrost-water in the plurality of holes and the drain or around each of the plurality of holes and the drain is prevented from freezing and the defrost-water can be reliably drained to the outside of the outside casing via the plurality of holes and the drain.

Advantageous Effects of Invention

In accordance with the air conditioner disclosed above, it is possible to satisfactorily prevent noise from entering an indoor space while including a casing fitted into an opening formed in a building wall partitioning an outdoor space and the indoor space from each other.

MODE(S) FOR CARRYING OUT THE INVENTION

Figure 1:
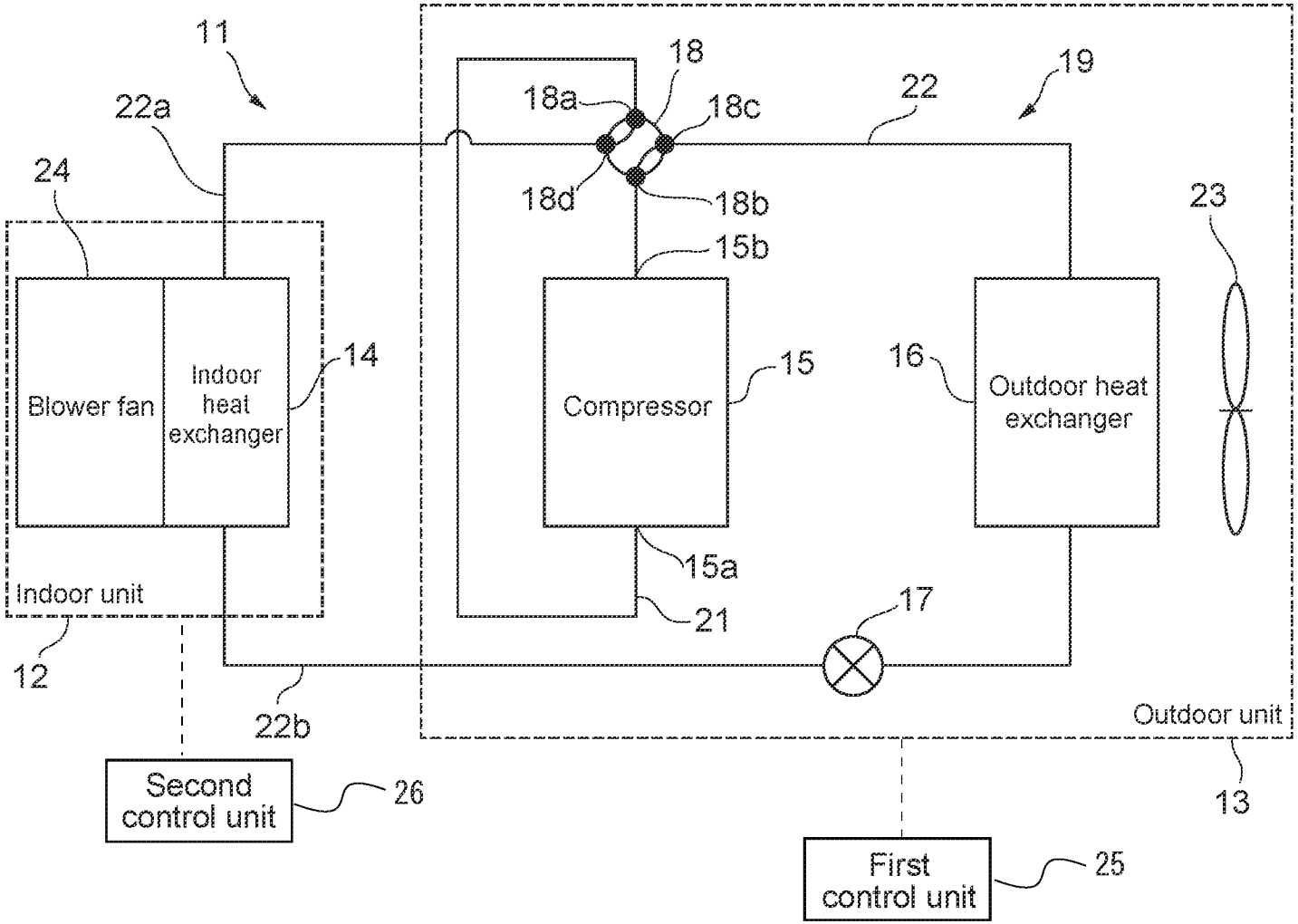
FIG. 1 is a block diagram schematically showing a configuration of an air conditioner according to an embodiment of the present invention.

FIG. 1 schematically shows a configuration of an air conditioner 11 according to an embodiment of the present invention. The air conditioner 11 includes an indoor unit 12 and an outdoor unit 13. The indoor unit 12 is installed in, for example, an indoor space in a building. The indoor unit 12 can be fixed to a wall surface of the indoor space at a height of 2 m or more from a floor surface of the indoor space, for example. In addition, the indoor unit 12 may be installed in a space corresponding to the indoor space. The indoor unit 12 houses an indoor heat exchanger 14. The outdoor unit 13 houses a compressor 15, an outdoor heat exchanger 16, an expansion valve 17, and a four-way valve 18. The indoor heat exchanger 14, the compressor 15, the outdoor heat exchanger 16, the expansion valve 17, and the four-way valve 18 form a refrigeration circuit (refrigerant circuit) 19. Further, the outdoor unit 13 is controlled by a first control unit 25 and the indoor unit 12 is controlled by a second control unit 26. The first control unit 25 and the second control unit 26 transmit/receive signals to/from each other.

The refrigeration circuit 19 includes a first circulation path 21. The first circulation path 21 connects a first port 18*a* and a second port 18*b* of the four-way valve 18 to each other. The compressor 15 is disposed in the first circulation path 21. A suction pipe 15*a* of the compressor 15 is connected to the first port 18*a* of the four-way valve 18 via a refrigerant pipe. A gas refrigerant is supplied from the first port 18*a* to the suction pipe 15*a* of the compressor 15. The compressor 15 compresses the low-pressure gas refrigerant to a predetermined pressure. A discharge pipe 15*b* of the compressor 15 is connected to the second port 18*b* of the four-way valve 18 via a refrigerant pipe. A gas refrigerant is supplied from the discharge pipe 15*b* of the compressor 15 to the second port 18*b* of the four-way valve 18. The refrigerant pipe may be, for example, a copper pipe.

The refrigeration circuit 19 further includes a second circulation path 22. The second circulation path 22 connects a third port 18*c* and a fourth port 18*d* of the four-way valve 18 to each other. The outdoor heat exchanger 16, the expansion valve 17, and the indoor heat exchanger 14 are incorporated in the second circulation path 22 in order from the third port 18*c* side. The outdoor heat exchanger 16 exchanges heat energy between the refrigerant passing through the outdoor heat exchanger 16 and the air in contact with the outdoor heat exchanger 16. The indoor heat exchanger 14 exchanges heat energy between the refrigerant passing through the indoor heat exchanger 14 and the air in contact with the indoor heat exchanger 14. The second circulation path 22 includes a gas pipe 22*a* that is connected to the fourth port 18*d* of the four-way valve 18, is drawn from the outdoor unit 13, and extends toward the indoor heat exchanger 14, and a liquid pipe 22*b* that is connected to the expansion valve 17, is drawn from the outdoor unit 13, and extends toward the indoor heat exchanger 14.

A blower fan 23 is incorporated in the outdoor unit 13. The blower fan 23 ventilates the outdoor heat exchanger 16. The blower fan 23 generates an air flow in accordance with rotation of an impeller, for example. The air flow passes through the outdoor heat exchanger 16 by the action of the blower fan 23. The outdoor air passes through the outdoor heat exchanger 16 and exchanges heat with a refrigerant. The heat-exchanged cold or warm air flow is blown out from the outdoor unit 13. The flow rate of the air flow passing through is adjusted in accordance with the rotation speed of the impeller.

A blower fan 24 is incorporated in the indoor unit 12. The blower fan 24 ventilates the indoor heat exchanger 14. The blower fan 24 generates an air flow in accordance with rotation of an impeller. Indoor air is sucked into the indoor unit 12 by the action of the blower fan 24. The indoor air passes through the indoor heat exchanger 14 and exchanges heat with a refrigerant. The heat-exchanged cold or warm air flow is blown out from the indoor unit 12. The flow rate of the air flow passing through is adjusted in accordance with the rotation speed of the impeller.

In the case where a cooling operation is performed in the refrigeration circuit 19, the four-way valve 18 connects the second port 18*b* and the third port 18*c* to each other and connects the first port 18*a* and the fourth port 18*d* to each other. Therefore, a high-temperature and high-pressure refrigerant is supplied from the discharge pipe 15*b* of the compressor 15 to the outdoor heat exchanger 16. The refrigerant flows through the outdoor heat exchanger 16, the expansion valve 17, and the indoor heat exchanger 14 in order. The outdoor heat exchanger 16 dissipates heat from the refrigerant to the outside air. The expansion valve 17 reduces the pressure of the refrigerant to a low pressure. The pressure-reduced refrigerant absorbs heat from the surrounding air in the indoor heat exchanger 14. Cool air is generated. The cool air is blown out into the indoor space by the action of the blower fan 24.

In the case where a heating operation is performed in the refrigeration circuit 19, the four-way valve 18 connects the second port 18*b* and the fourth port 18*d* to each other and connects the first port 18*a* and the third port 18*c* to each other. A high-temperature and high-pressure refrigerant is supplied from the compressor 15 to the indoor heat exchanger 14. The refrigerant flows through the indoor heat exchanger 14, the expansion valve 17, and the outdoor heat exchanger 16 in order. The indoor heat exchanger 14 dissipates heat from the refrigerant to the surrounding air. Warm air is generated. The warm air is blown out into the indoor space by the action of the blower fan 24. The expansion valve 17 reduces the pressure of the refrigerant to a low pressure. The pressure-reduced refrigerant absorbs heat from the surrounding air in the outdoor heat exchanger 16. After that, the refrigerant returns to the compressor 15.

When the heating operation is performed for a long time and the temperature of the outdoor heat exchanger 16 reaches below the freezing point, for example, frost adheres to the outdoor heat exchanger 16 in some cases. Therefore, in the heating operation, a defrosting operation for removing frost from the outdoor heat exchanger 16 is periodically performed. In the case where the defrosting operation is performed in the refrigeration circuit 19, the four-way valve 18 connects the second port 18*b* and the third port 18*c* to each other and connects the first port 18*a* and the fourth port 18*d* to each other, similarly to the cooling operation. A high-temperature and high-pressure refrigerant is supplied from the discharge pipe 15*b* of the compressor 15 to the outdoor heat exchanger 16. The refrigerant flows through the outdoor heat exchanger 16, the expansion valve 17, and the indoor heat exchanger 14 in order. The outdoor heat exchanger 16 dissipates heat from the refrigerant to the outside air. The blower fan 24 is stopped. As a result, frost adhered to the outdoor heat exchanger 16 melts, and this frost is defrosted from the outdoor heat exchanger 16. Note that water formed when frost has melted in the defrosting operation is referred to as defrost-water. Further, since the defrosting operation is periodically performed during the heating operation, the heating operation may include the defrosting operation, and the defrosting operation and the heating operation may be collectively referred to as the heating operation.

Figure 2:
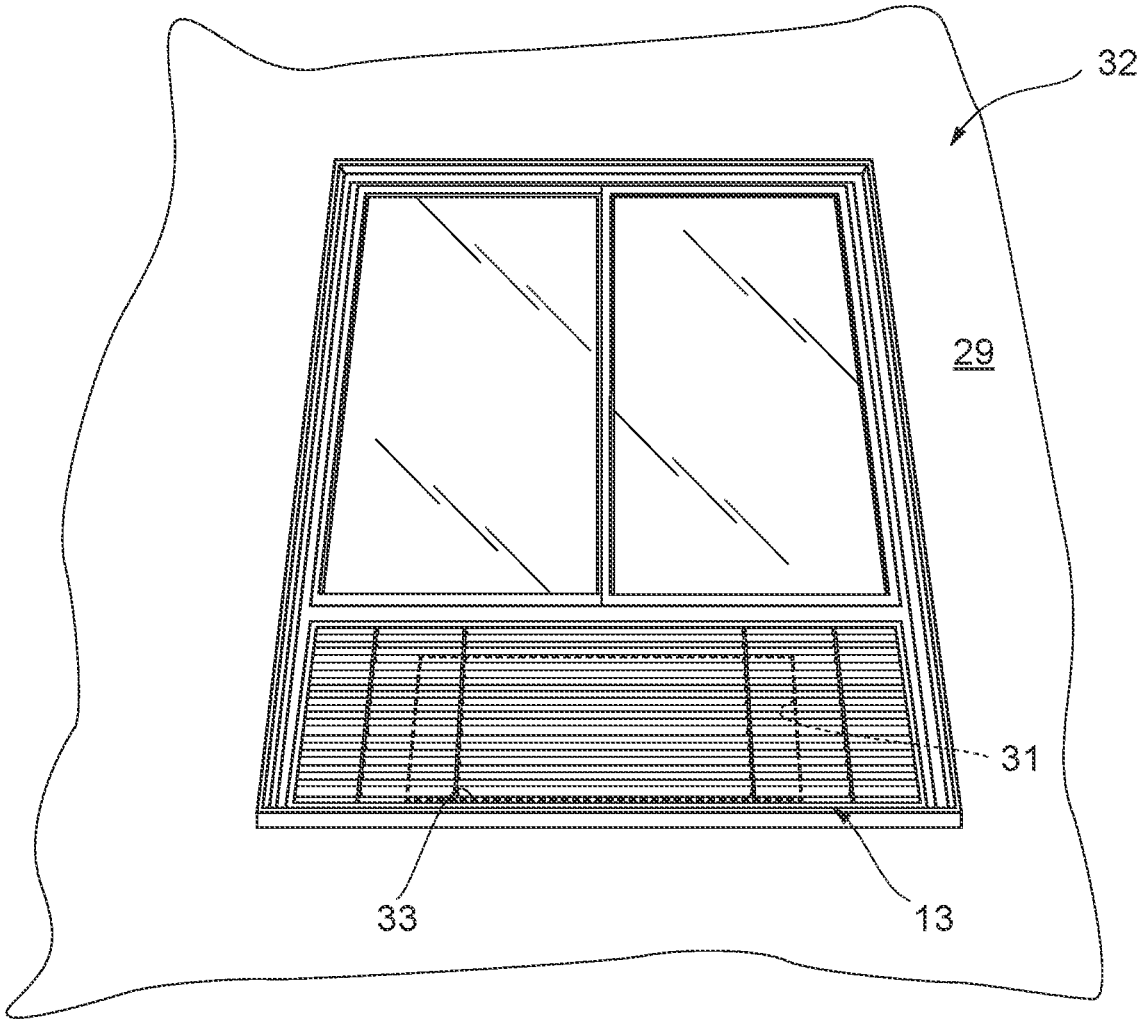
FIG. 2 is a conceptual diagram schematically showing an outdoor unit observed from an outer wall of a building.
Figure 3:
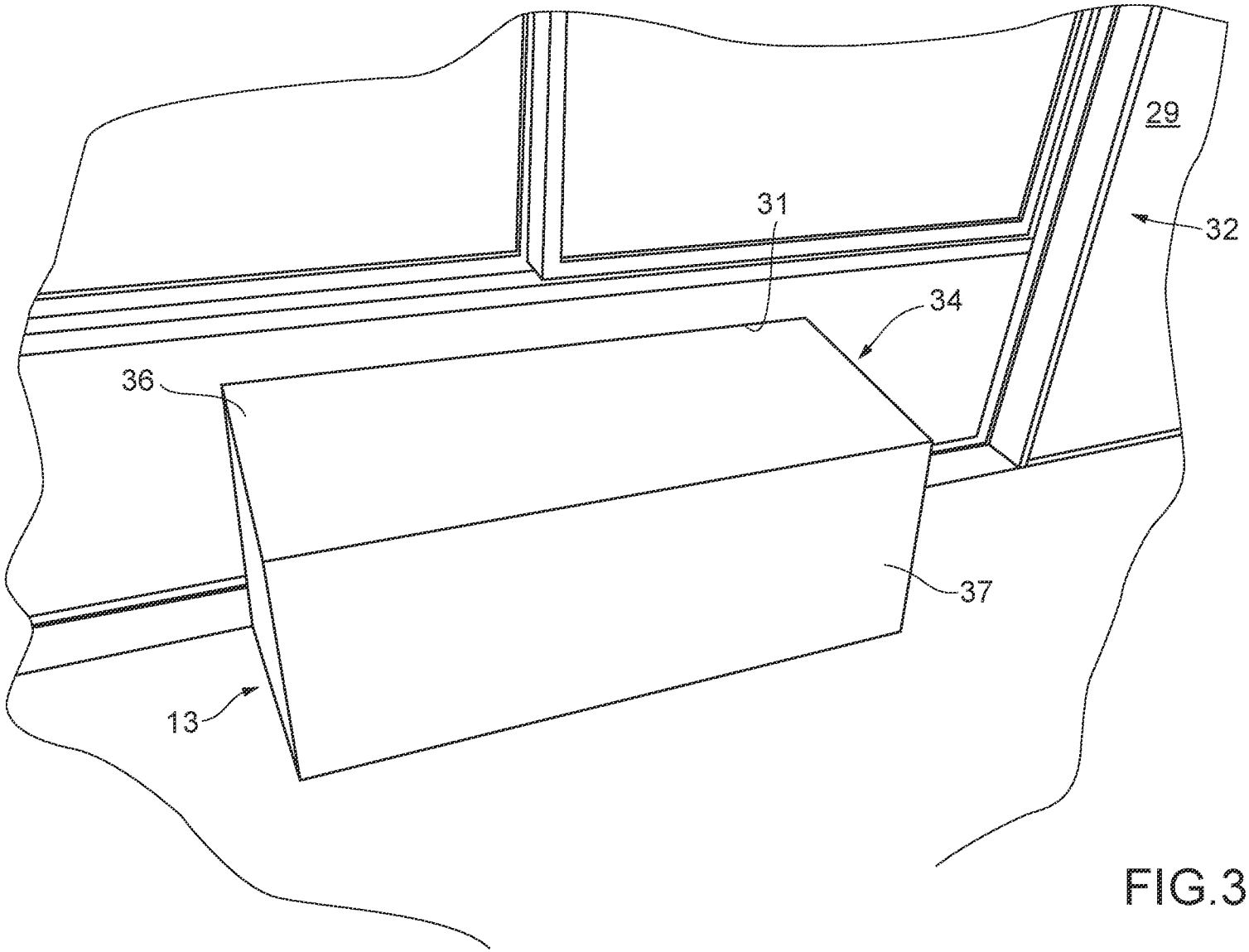
FIG. 3 is a conceptual diagram schematically showing the outdoor unit observed in an indoor space.

As shown in FIG. 2 and FIG. 3, the outdoor unit 13 is fitted into an opening 31 formed in a building wall 29 partitioning an outdoor space and an indoor space from each other. The opening 31 opens to the outdoor space (space outside the building) on an outer wall surface of a building 32. Here, the outdoor unit 13 includes an outside casing 34 defining an internal space that is open to the outdoor space by an open port 33 and isolated from the indoor space by being surrounded by a sound insulation wall. The opening 31 of the building wall 29 has the dimensions determined for PTAC (Packaged Terminal Air Conditioner). The opening 31 penetrates the building wall 29 and connects the indoor space to the outdoor space.

Figure 4:
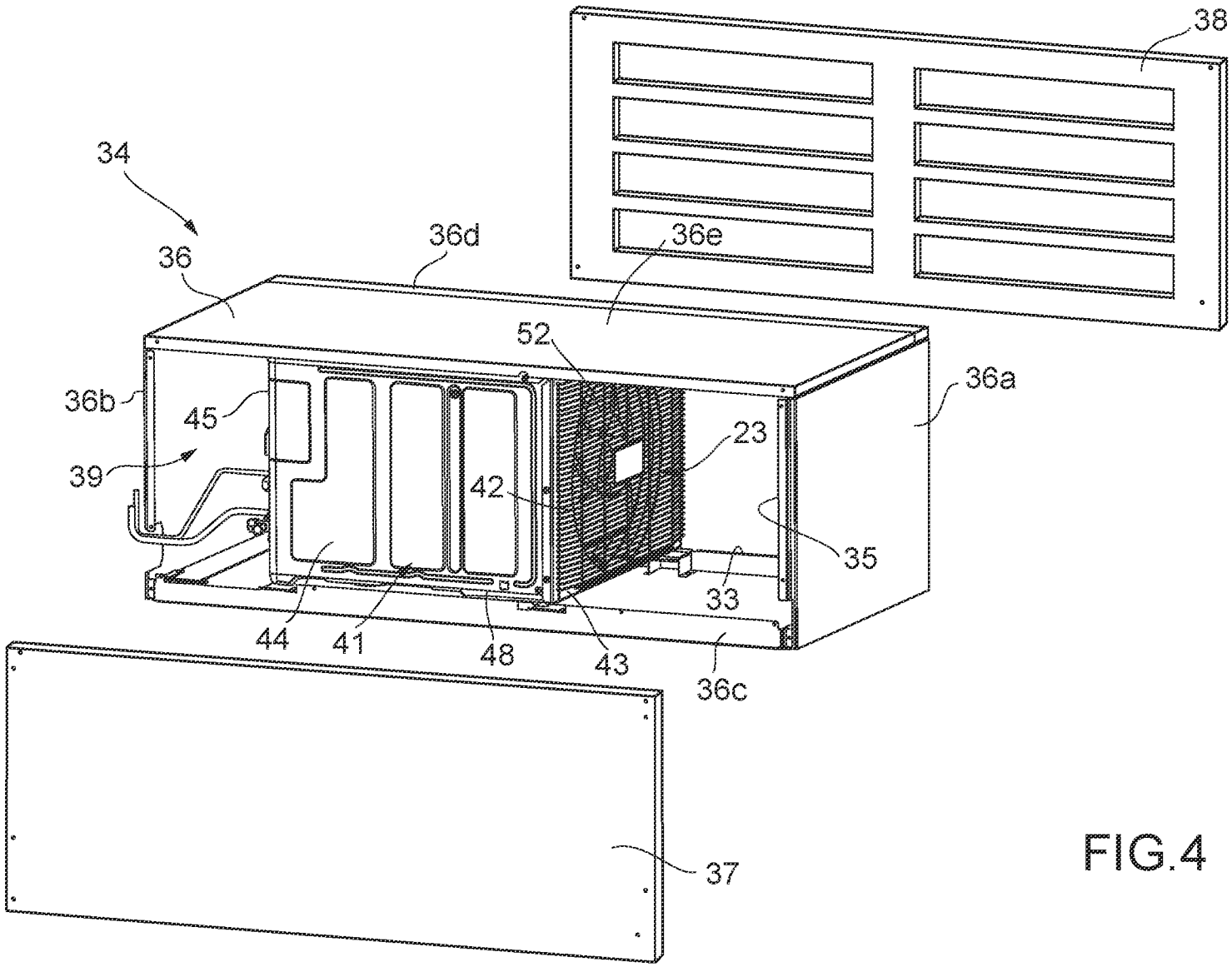
FIG. 4 is an exploded perspective view of the outdoor unit.

As shown in FIG. 4, the outside casing 34 includes a wall body 36 that defines a storage port 35 opening toward the indoor space, a front panel 37 that is joined to the wall body 36 to close the storage port 35, and a grill 38 that is connected to the wall body 36 and installed in the open port 33. The wall body 36 includes a first side wall (right side wall) 36*a* that extends along a virtual plane orthogonal to a wall surface of the building wall 29 at the right end of the opening 31, a second side wall (left side wall) 36*b* that extends along the virtual plane orthogonal to the wall surface of the building wall 29 at the left end of the opening 31, a bottom plate 36*c* that is supported so as to be slidable with respect to the wall body 36 in parallel to the first side wall 36*a* and the second side wall 36*b*, a first top wall 36*d* that extends from the ends of the first side wall 36*a* and the second side wall 36*b* on the outdoor space side toward the indoor space side and is joined to the upper ends of the first side wall 36*a* and the second side wall 36*b* to close an internal space 39 sandwiched between the first side wall 36*a* and the second side wall 36*b* from above, and a second top wall 36*e* that extends from the first top wall 36*d* toward the indoor space side to the ends of the first side wall 36*a* and the second side wall 36*b* on the indoor space side to close the internal space 39 from above so as to be openable and closable. The second side wall 36*b* faces the first side wall 36*a* from the right and left direction (horizontal direction parallel to the indoor floor surface at the time of installation) and sandwiches the internal space 39 with the first side wall 36*a*. The first top wall 36*d* and the second top wall 36*e* face the bottom plate 36*c* from the up and down direction (a vertical direction perpendicular to the indoor floor surface at the time of installation or a direction in which the bottom plate 36*c* and a bottom plate 48 face each other) and sandwich the internal space 39 with the bottom plate 36*c*. The grill 38 may be embedded in the outer wall of the building 32. In this case, the grill 38 may be omitted from the outside casing 34.

The first side wall 36*a*, the second side wall 36*b*, the bottom plate 36*c*, the first top wall 36*d*, the second top wall 36*e*, and the front panel 37 are each formed as a sound insulation wall. That is, for example, a sound insulation material (sheet) formed of an urethane resin may be stacked on inner surfaces of the first side wall 36*a*, the second side wall 36*b*, the bottom plate 36*c*, the first top wall 36*d*, the second top wall 36*e*, and the front panel 37. The sound insulation material may be sandwiched between metal plates, for example. The joints between the first side wall 36*a* and the bottom plate 36*c*, the first top wall 36*d*, and the second top wall 36*e* can be joined without a gap. The joints between the second side wall 36*b* and the bottom plate 36*c*, the first top wall 36*d*, the second top wall 36*e* can be joined without a gap, similarly. The joints between the front panel 37 and the bottom plate 36*c*, the second top wall 36*e*, the first side wall 36*a*, and the second side wall 36*b* can be joined without a gap, similarly. The sound insulation material such as an urethane resin is capable of functioning also as a thermal insulation material at the same time.

An inside casing 41 that houses the outdoor heat exchanger 16 is disposed in the internal space 39. The inside casing 41 is housed between the first side wall 36*a* and the second side wall 36*b*. The inside casing 41 is supported by the bottom plate 36*c* from below.

Figure 5:
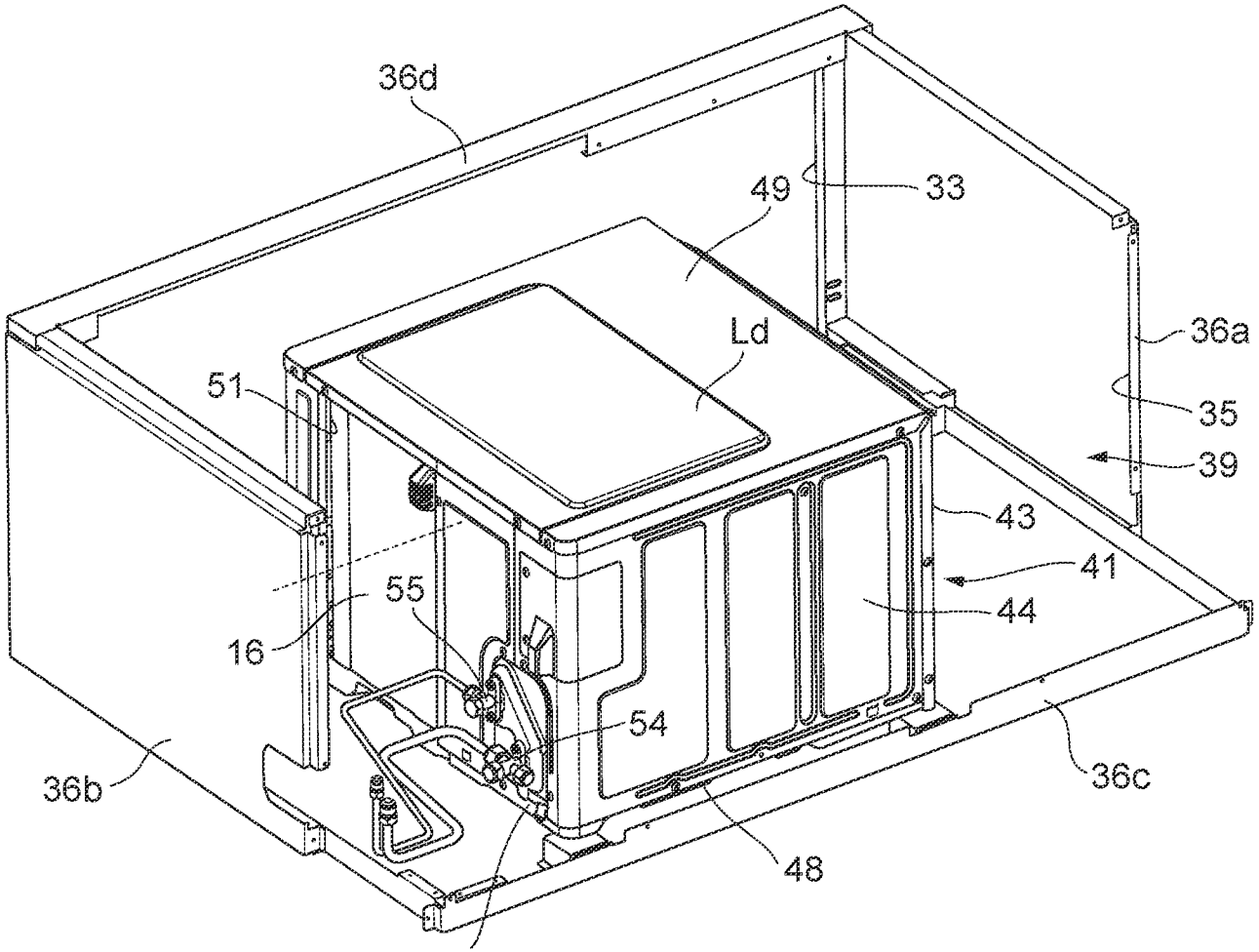
FIG. 5 is a perspective view of the outdoor unit observed from the indoor space side.
Figure 6:
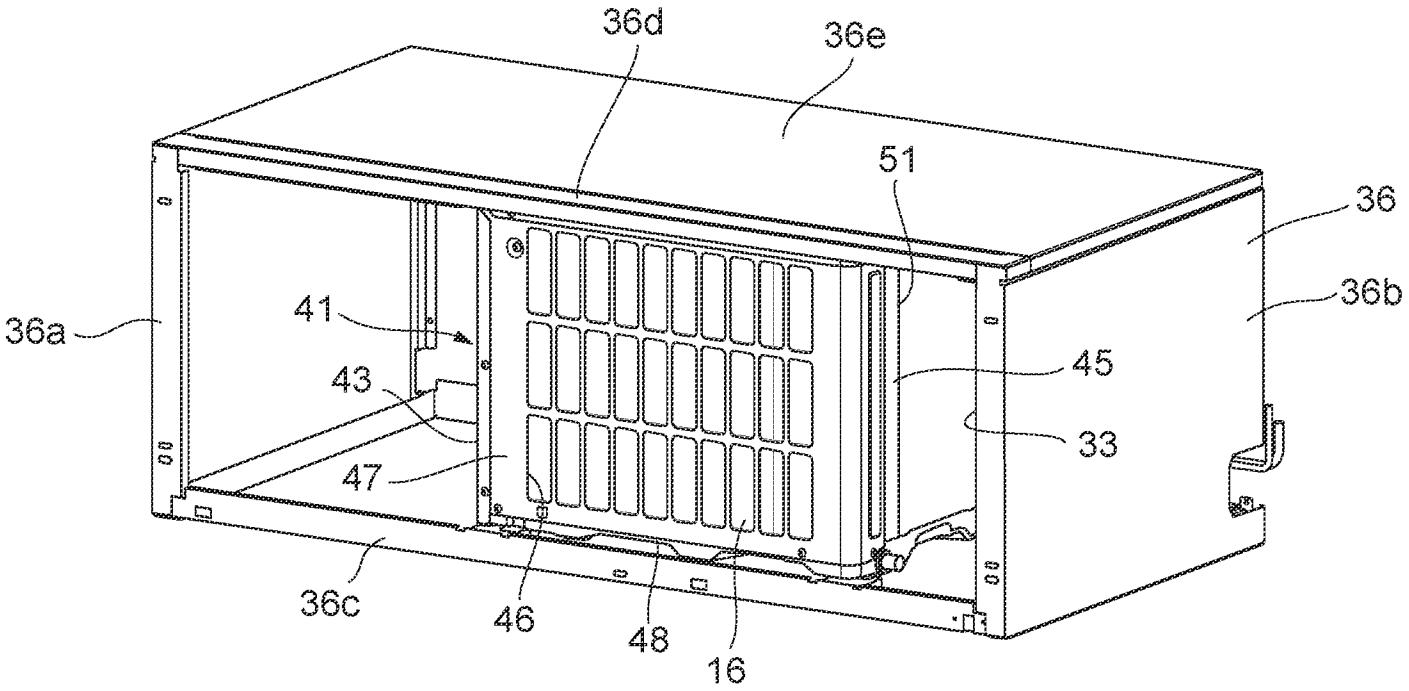
FIG. 6 is a perspective view of the outdoor unit observed from the outdoor space side.

The inside casing 41 includes a first side plate (right side plate) 43 that faces the first side wall 36*a* of the outside casing 34 and defines a blower port 42, a second side plate (front plate) 44 that is coupled to an end of the first side plate 43 (end on the indoor space side) in a posture orthogonal to the first side plate 43 and partitions the air passage in the inside casing 41 from the internal space 39 of the outside casing 34, a third side plate 45 that faces the first side plate 43 as shown in FIG. 5 and is coupled to an end of the second side plate 44 to define an air passage between the third side plate 45 and the first side plate 43, and a fourth side plate 47 that faces the second side plate 44 as shown in FIG. 6 and is coupled to the first side plate 43 and the third side plate 45 to define a suction port 46 that is open to the outdoor space. The first side plate 43, the second side plate 44, the third side plate 45, and the fourth side plate 47 rise from the bottom plate 48 in the vertical direction. As shown in FIG. 5, a top plate 49 is joined to the upper ends of the first side plate 43, the second side plate 44, the third side plate 45, and the fourth side plate 47. An air passage is defined between the bottom plate 48 and the top plate 49. Here, a suction port 51 that partially faces the second side wall 36*b* of the outside casing 34 is defined in the third side plate 45.

Figure 7:
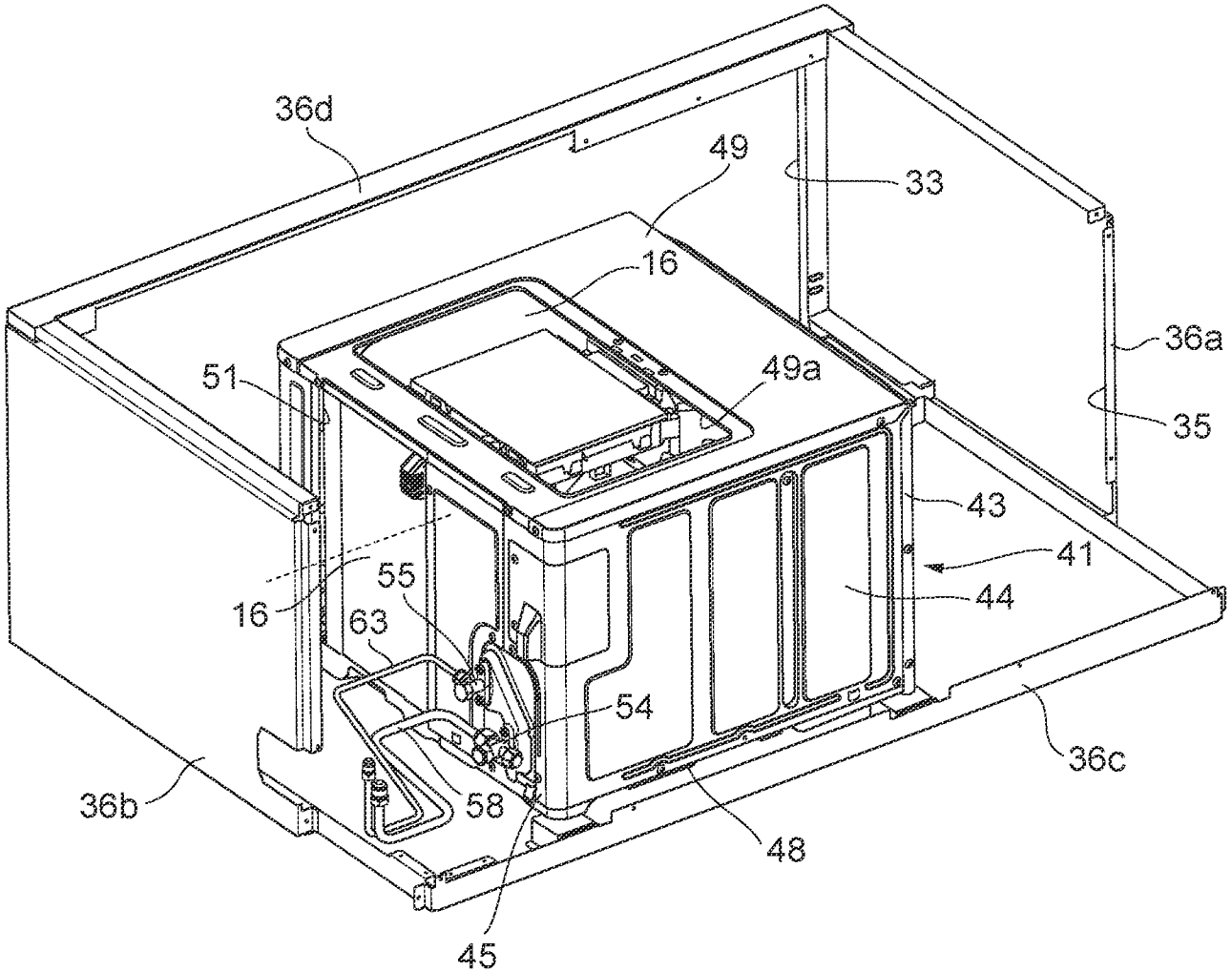
FIG. 7 is a perspective view of the outdoor unit in a state where an opening of a top plate of an inside casing is opened, which corresponds to FIG. 5.

As shown in FIG. 5 and FIG. 6, the outdoor heat exchanger 16 is disposed along the suction port 51 of the third side plate 45 and the suction port 46 of the fourth side plate 47 in the inside casing 41. As shown in FIG. 4, the blower fan 23 is installed in the blower port 42. The blower fan 23 may be an axial flow fan. The blower fan 23 includes a blade 52 that faces the blower port 42 and rotates around a horizontal axis line. The blade 52 creates an air flow in an axial direction during rotation. The outside air enters the inside casing 41 from the open port 33 through the suction ports 46 and 51. The outside air passes through the outdoor heat exchanger 16. Heat energy is exchanged between the air passing through and the refrigerant in the outdoor heat exchanger 16. The air after heat exchange is blown out from the blower port 42 toward the second side wall 36*b*. Here, as shown in FIG. 5 and FIG. 7, a lid Ld that closes an opening 49*a* capable of accessing the air passage in the inside casing 41 may be attached to the top plate 49. A path for accessing a space behind the blower fan 23 and a space inside the outdoor heat exchanger 16 can be provided in accordance with the opening and closing of the lid Ld.

Figure 8:
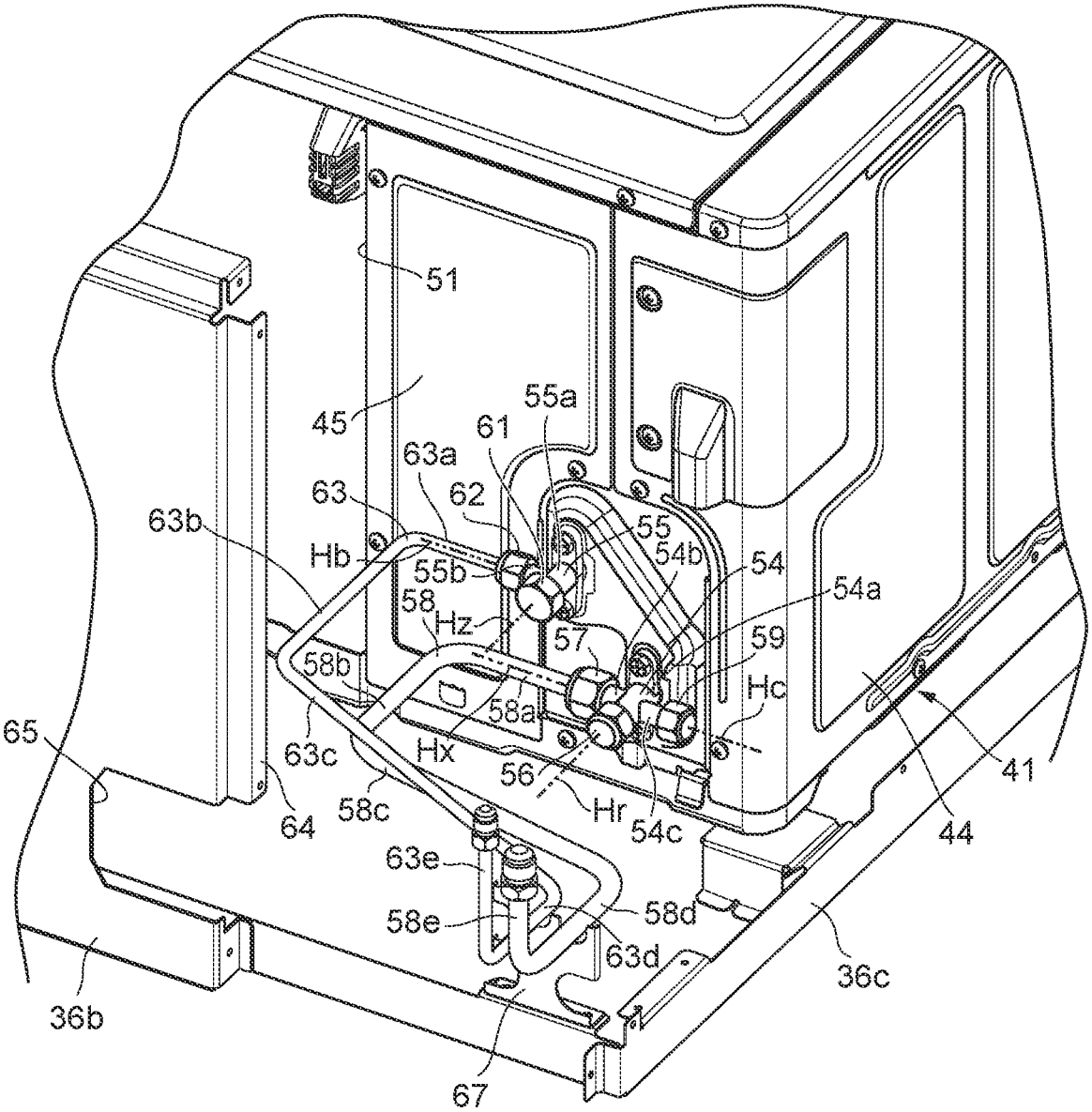
FIG. 8 is a perspective view schematically showing configurations of a first switching valve and a second switching valve.

The refrigeration circuit 19 includes a first switching valve 54 that is incorporated in the gas pipe 22*a*, is connected to the outdoor heat exchanger 16 via the compressor 15, and protrudes from the third side plate 45 of the inside casing 41, and a second switching valve 55 that is incorporated in the liquid pipe 22*b*, is connected to the outdoor heat exchanger 16 via the expansion valve 17, and protrudes from the third side plate 45 of the inside casing 41. As shown in FIG. 8, the first switching valve 54 includes an introduction pipe 54*a* that extends in a vertical direction from the surface of the third side plate 45, a first connection pipe 54*b* that branches from the introduction pipe 54*a* and forms a connection port having an axis line set in parallel to the surface of the third side plate 45, and a second connection pipe 54*c* that branches from the introduction pipe 54*a* and forms a suction port having an axis line set in parallel to the surface of the third side plate 45. A screw member 56 that switches the opening and closing of the connection port on the basis of rotation of a screw whose rotation axis is an axis line set coaxially with the introduction pipe 54*a* is attached to the introduction pipe 54*a*. The screw member 56 is displaced in the axial direction in accordance with rotation around a horizontal axis line Hr. A shape of a hexagon bolt that engages with the mouth of a wrench and receives an operation of the wrench around the axis is formed in the screw member 56.

The first connection pipe 54*b* rearwardly extends in the horizontal direction from the introduction pipe 54*a* toward the open port 33 side. A first auxiliary refrigerant pipe 58 is connected to the first connection pipe 54*b* in accordance with tightening of a flare nut 57 around an axis line Hx. The gas passage of the first auxiliary refrigerant pipe 58 is connected to the connection port of the first connection pipe 54*b*. The first auxiliary refrigerant pipe 58 is drawn from the outside casing 34 to the indoor space on the indoor space than the edge of the second side wall 36*b* on the indoor space side. The first auxiliary refrigerant pipe 58 includes a first region 58*a* that is linearly continuous from the first connection pipe 54*b* and extends in the horizontal direction toward the outdoor space side, a second region 58*b* that bends from the first region 58*a* and extends in the horizontal direction so as to be away from the third side plate 45, a third region 58*c* that bends from the second region 58*b* and extends in the horizontal direction in parallel to the first region 58*a* toward the storage port 35, a fourth region 58*d* that bends from the third region 58*c*, extends in the horizontal direction so as to be away from the third side plate 45, and penetrates the second side wall 36*b* of the outside casing 34, and a fifth region 58*e* that bends from the fourth region 58*d* and rise in the vertical direction on the outside of the outside casing 34.

The second connection pipe 54*c* forwardly extends in the horizontal direction from the introduction pipe 54*a* toward the storage port 35 side. The first connection pipe 54*b* and the second connection pipe 54*c* extend from the introduction pipe 54*a* in a straight line in orientations opposite to each other. A closing bolt 59 that closes the open end of the suction port on the basis of rotation of a screw around an axis line Hc is connected to the second connection pipe 54*c*. A vacuum pump is connected to the second connection pipe 54*c* for evacuating the refrigeration circuit 19.

The second switching valve 55 includes an introduction pipe 55*a* that extends in the vertical direction from the surface of the third side plate 45 and a connection pipe 55*b* that branches from the introduction pipe 55*a* and forms a connection port having an axis line set in parallel to the surface of the third side plate 45. A screw member 61 that switches the opening and closing of the connection port on the basis of rotation of a screw around a horizontal axis line Hz set coaxially with the introduction pipe 55*a* is attached to the introduction pipe 55*a*. The screw member 61 is displaced in the axial direction in accordance with rotation around the horizontal axis line Hz. A shape of a hexagon bolt that engages with the mouth of a wrench and receives an operation of the wrench around the axis is formed in the screw member 61.

The connection pipe 55*b* rearwardly extends in the horizontal direction from the introduction pipe 55*a* toward the open port 33 side. A second auxiliary refrigerant pipe 63 is connected to the connection pipe 55*b* in accordance with tightening of a flare nut 62 around an axis line Hb. The liquid passage of the second auxiliary refrigerant pipe 63 is connected to the connection port of the connection pipe 55*b*. The second auxiliary refrigerant pipe 63 is drawn from the outside casing 34 to the indoor space on the indoor space side than the edge of the second side wall 36*b* on the indoor space side. The second auxiliary refrigerant pipe 63 includes a first region 63*a* that is linearly continuous from the connection pipe 55*b* and extends in the horizontal direction toward the outdoor space side, a second region 63*b* that bends from the first region 63*a* and extends in the horizontal direction so as to be away from the third side plate 45, a third region 63*c* that bends from the second region 63*b* and downwardly extends toward the storage port 35 in parallel to the plate surface of the third side plate 45, a fourth region 63*d* that bends from the third region 63*c*, extends in the horizontal direction so as to be away from the third side plate 45, and penetrates the second side wall 36*b* of the outside casing 34, and a fifth region 63*e* that bends from the fourth region 63*d* and rises in the vertical direction on the outside of the outside casing 34.

Figure 9:
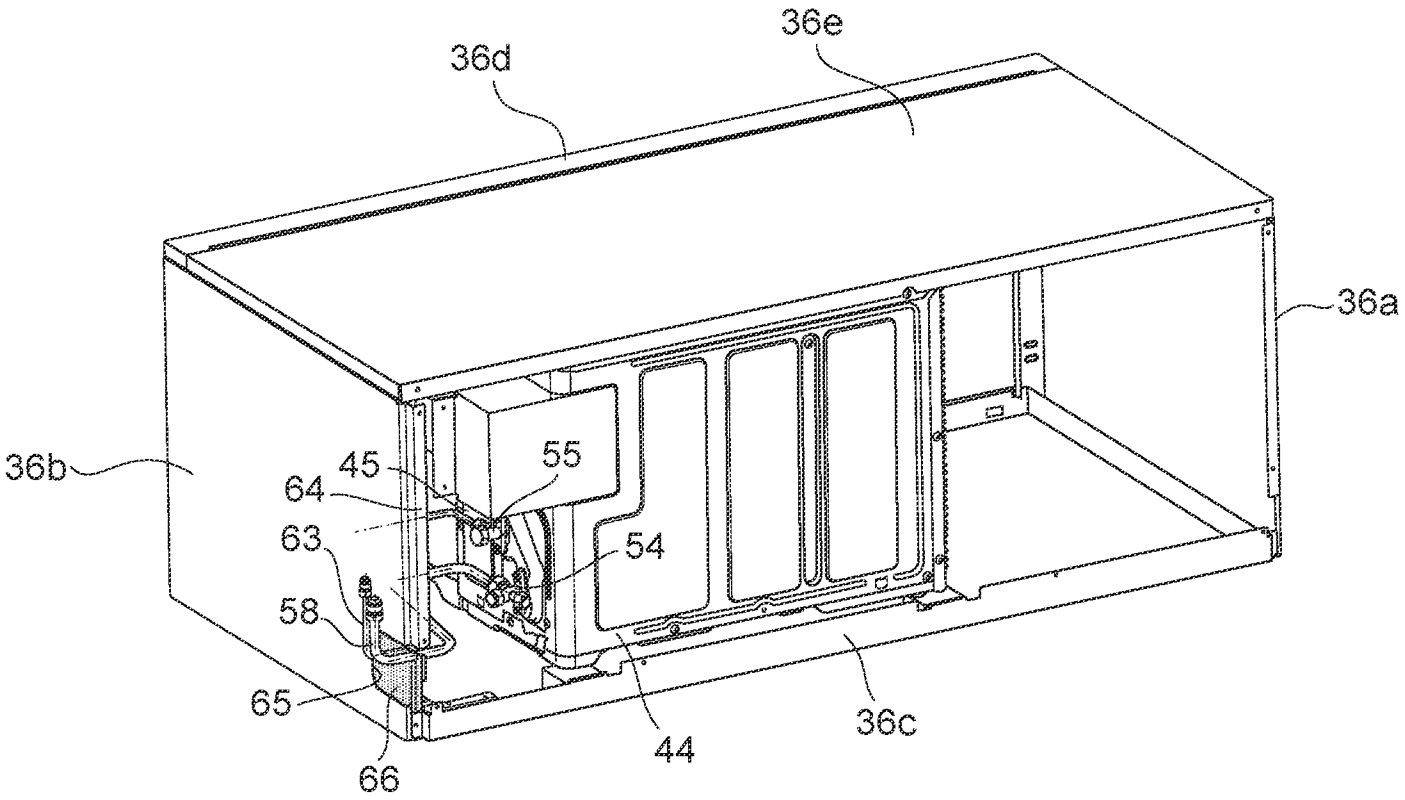
FIG. 9 is a perspective view of the outdoor unit observed from the indoor space side.

The edge of the second side wall 36*b* on the indoor space includes a joining edge 64 that is partitioned in a direction perpendicular to the floor surface and is fitted into the front panel 37, and an escape edge 65 that is recessed from the joining edge 64 toward the outdoor space side and accepts entry of the first auxiliary refrigerant pipe 58 and the second auxiliary refrigerant pipe 63. The escape edge 65 is closed by the front panel 37. As shown in FIG. 9, the escape edge 65 is hardened with a resin material 66. The resin material 66 is formed in the recess of the escape edge 65 to fills the space present around the first auxiliary refrigerant pipe 58 and the second auxiliary refrigerant pipe 63. As shown in FIG. 8, a bracket 67 that supports the fourth region 58*d* of the first auxiliary refrigerant pipe 58 and the fourth region 63*d* of the second auxiliary refrigerant pipe 63 from below is attached to the bottom plate 36*c* of the outside casing 34. The bracket 67 positions the first auxiliary refrigerant pipe 58 and the second auxiliary refrigerant pipe 63 in the recess of the escape edge 65.

Figure 10:
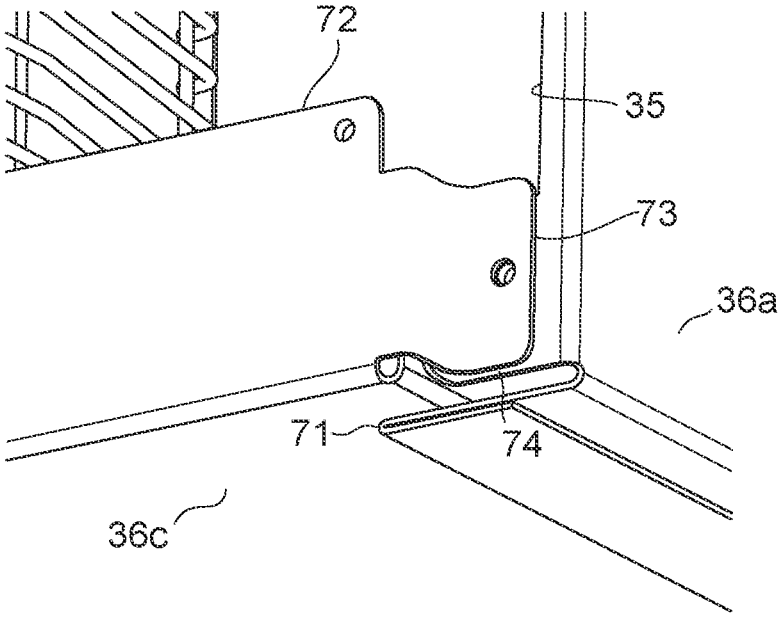
FIG. 10 is a partial perspective view schematically showing a structure of a guide plate for guiding sliding of a bottom plate on a side wall of an outside casing.
Figure 10:
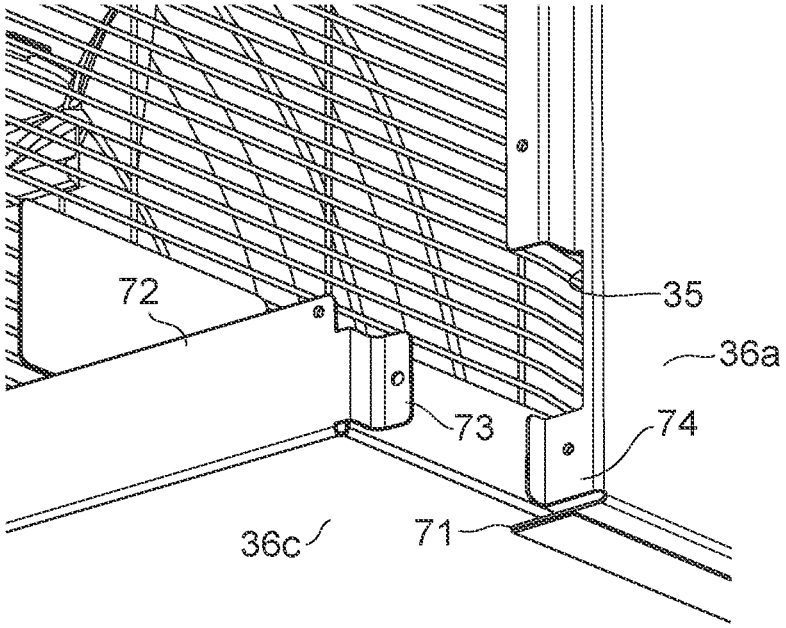

As shown in Part (A) of FIG. 10 and Part (B) of FIG. 10, a guide plate 71 that is bending-molded inwardly from the plate material of the first side wall 36*a* and linearly extends from the storage port 35 to the open port 33 is joined to the lower end of the first side wall 36*a*. A one-side edge (right edge) of the bottom plate 36*c* is received by the guide plate 71 so as to be slidable in parallel to the first side wall 36*a*. Similarly, although not shown, a guide plate that is bending-molded inwardly from the plate material of the second side wall 36*b* and linearly extends from the storage port 35 to the open port 33 is joined to the lower end of the second side wall 36*b*. The other-side edge (left edge) of the bottom plate 36*c* is received by the guide plate so as to be slidable in parallel to the second side wall 36*b*. In this way, the bottom plate 36*c* is capable of sliding and moving on the guide plate 71 in a specific range. A vertical wall 72 that is bending-molded upwardly from the plate material of the bottom plate 36*c* is joined to the front end (end on the indoor space side) of the bottom plate 36*c*. A stacking piece 73 that extend toward the outside in the right and left direction is formed at each of the right and left ends of the vertical wall 72. A regulatory piece 74 that inwardly extends is formed at the front end of the first side wall 36*a* above the guide plate 71. The regulatory piece 74 is bending-molded inwardly from the plate material of the first side wall 36*a*. When the stacking piece 73 is stacked on the regulatory piece 74, the bottom plate 36*c* is housed in the internal space of the outside casing 34.

The outdoor unit 13 is combined with the indoor unit 12 to provide a separate type air conditioner 11. When the outside casing 34 is fitted into the opening 31 of the building wall 29, the internal space 39 of the outside casing 34 is separated from the indoor space by the sound insulation wall. It is possible to prevent air from flowing from the internal space 39 toward the indoor space. The outdoor unit 13 exchanges heat between the outside air entering the internal space 39 and the refrigerant. The efficiency of heat exchange can be satisfactorily achieved. Here, the noise in the outdoor space is blocked by the sound insulation wall. It is possible to satisfactorily prevent noise from entering. The quietness of the indoor space can be satisfactorily achieved.

The opening 31 of the building wall 29 has the dimensions determined for PTAC. Here, since it may dispose only the outdoor unit 13 in the opening 31 of the building wall 29, a large space can be provided between the blower port 42 and the first side wall 36*a* of the outside casing 34. In this way, the air after heat exchange can be efficiently discharged from the blower port 42 toward the outdoor space. The flow rate of air passing through the outdoor heat exchanger 16 can be increased. It is possible to increase the efficiency of heat exchange in the outdoor unit 13.

When installing the air conditioner 11, the outside casing 34 is assembled. The first side wall 36*a* and the second side wall 36*b* are assembled to the first top wall 36*d*. Subsequently, prior to assembling the bottom plate 36*c*, the assembly of the first side wall 36*a*, the second side wall 36*b*, and the first top wall 36*d* is installed in the opening 31 of the building wall 29. The assembly may be inserted from the indoor space into the opening 31 of the building wall 29. Here, the installation position of the second top wall 36*e* can be maintained in the indoor space.

Figure 11:
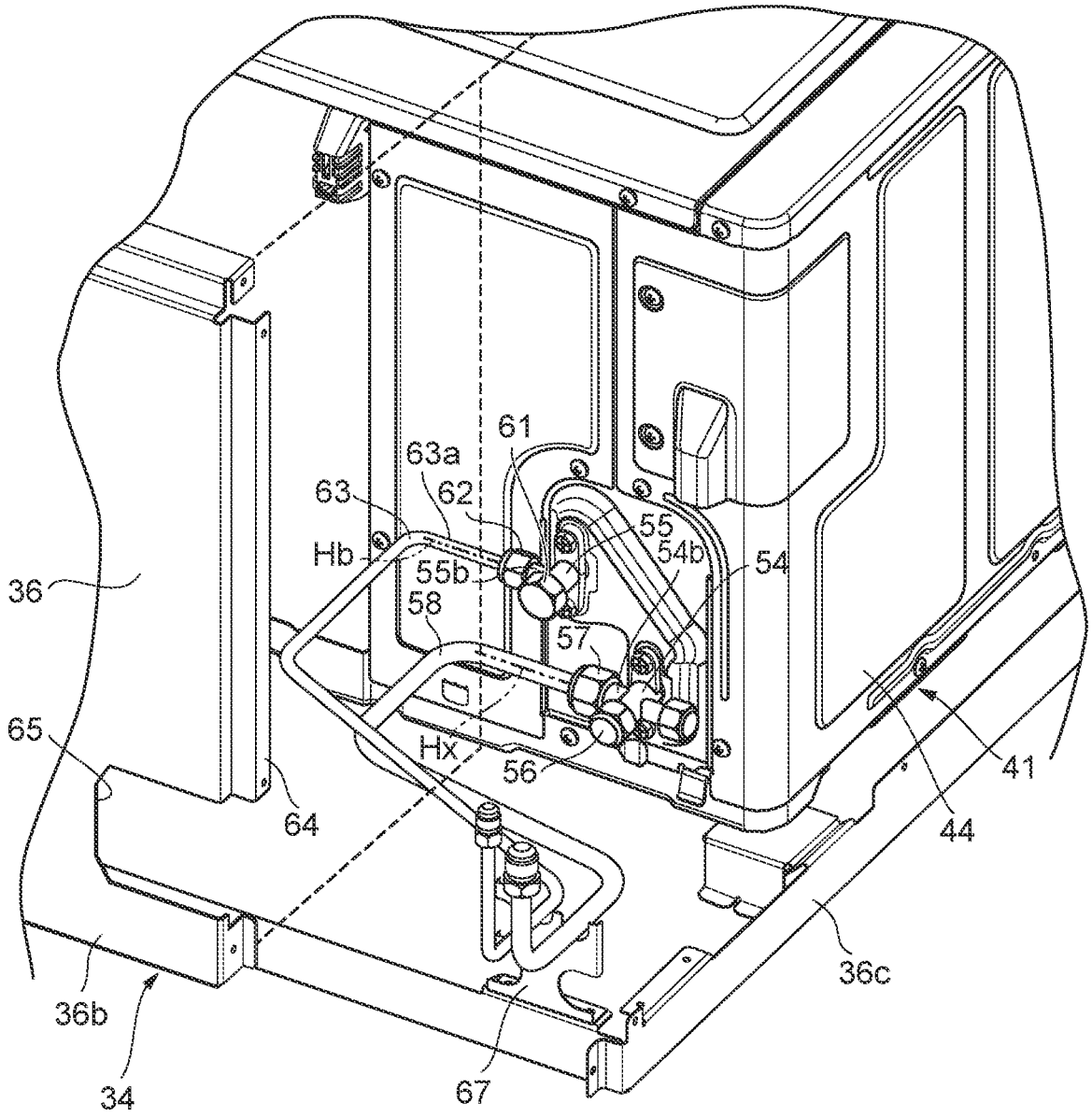
FIG. 11 is a perspective view schematically showing a state of the bottom plate before storage.

As shown in FIG. 11, the bottom plate 36*c* is coupled to the first side wall 36*a* and the second side wall 36*b*. The bottom plate 36*c* is installed on the guide plate 71 of the first side wall 36*a* and the guide plate of the second side wall 36*b*. At this time, the bottom plate 36*c* can be drawn as much as possible toward the indoor space side. When the inside casing 41 is installed on the bottom plate 36*c*, the first switching valve 54 and the second switching valve 55 are located on the indoor space side than the storage port 35 of the outside casing 34. Therefore, the movable range of the bottom plate 36*c* may be adjusted on the basis of the positional relationship between the first switching valve 54 and the second switching valve 55 and the joining edge 64 of the second side wall 36*b*.

When installing the air conditioner 11, the first auxiliary refrigerant pipe 58 and the second auxiliary refrigerant pipe 63 are respectively connected to the connection ports of the first switching valve 54 and the second switching valve 55. At the time of the connecting, the first auxiliary refrigerant pipe 58 can be supported by the first connection pipe 54*b* and the bracket 67. The second auxiliary refrigerant pipe 63 can be supported by the connection pipe 55*b* and the bracket 67. In this way, the first auxiliary refrigerant pipe 58 and the second auxiliary refrigerant pipe 63 can be positioned at fixed positions.

The flare nut 57 of the first auxiliary refrigerant pipe 58 is tightened with a wrench around the axis line Hx. The connecting can be liquid-tightly established. The flare nut 62 of the second auxiliary refrigerant pipe 63 is tightened with a wrench around the axis line Hb. The connecting can be liquid-tightly established. After connecting the first auxiliary refrigerant pipe 58 and the second auxiliary refrigerant pipe 63, the inside casing 41 is stored in the outside casing 34 from the storage port 35. At this time, since the flare nuts 57 and 62 are located on the indoor space side than the joining edge 64 of the second side wall 36*b*, the interference between the first auxiliary refrigerant pipe 58 or the second auxiliary refrigerant pipe 63 and the second side wall 36*b* of the outside casing 34 can be avoided. In this way, since the work with a wrench is performed prior to the storage in the outside casing 34, a sufficient work space can be provided. When connecting the first auxiliary refrigerant pipe 58 and the second auxiliary refrigerant pipe 63, the efficient work can be achieved.

In this embodiment, the outside casing 34 includes the bottom plate 36*c* that is supported so as to be slidable with respect to the wall body 36 in parallel to the second side wall 36*b* and supports the inside casing 41 from below. When storing the inside casing 41, the bottom plate 36*c* is capable of sliding relative to the wall body 36 of the outside casing 34. Therefore, the work of storing the inside casing 41 can be easily achieved. The efficient work can be achieved. When the bottom plate 36*c* is pushed into the wall body 36 as much as possible along the guide plate 71 of the first side wall 36*a* and the guide plate of the second side wall 36*b*, the inside casing 41 is stored in the internal space 39 of the outside casing 34. In the first side wall 36*a*, the stacking piece 73 of the bottom plate 36*c* is stacked on the regulatory piece 74. Similarly, in the second side wall 36*b*, the stacking piece of the bottom plate 36*c* is stacked on the regulatory piece.

After that, at the escape edge 65 of the second side wall 36*b*, the fluid of the resin material 66 is applied around the first auxiliary refrigerant pipe 58 and the second auxiliary refrigerant pipe 63. Waiting for the resin material 66 to solidify, the escape edge 65 is closed. The sound insulation properties of the outside casing 34 can be achieved. Since the bracket 67 functions as an aggregate of the fluid when applying the resin material 66, the resin material 66 can be satisfactorily held in the escape edge 65 until solidification.

After the gas pipe 22*a* and the liquid pipe 22*b* are respectively connected to the connection ports of the first switching valve 54 and the second switching valve 55, the connection ports of the first switching valve 54 and the second switching valve 55 are opened. In this way, a refrigerant is capable of flowing through the refrigerant pipe. When opening the first switching valve 54 and the second switching valve 55, the screw members 56 and 61 are respectively driven around the horizontal axis lines Hr and Hz. Here, since it may dispose only the outdoor unit 13 in the opening 31 of the building wall 29, a sufficient space can be provided between the second side wall 36*b* and the third side plate 45 of the inside casing 41. In the internal space 39 of the outside casing 34, for example, the work of respectively driving the screw members 56 and 61 around the horizontal axis lines Hr and Hz with a wrench can be satisfactorily achieved.

After storing the inside casing 41 in the internal space 39 of the outside casing 34, the second top wall 36*e* can be installed. The second top wall 36*e* is tightly joined to the upper end of the first side wall 36*a* and the upper end of the second side wall 36*b*. At the time of joining, for example, a sound insulation material formed of urethane can be sandwiched. At the joint between the first top wall 36*d* and the second top wall 36*e*, both of them are in contact with each other without a gap. In this way, the first top wall 36*d* is embedded in the building wall 29 to form a sound insulation wall in the building wall 29. In the case where the second top wall 36*e* is disposed in the indoor space, a path for accessing the internal space 39 in accordance with the opening and closing of the second top wall 36*e* can be provided. Even after installing the air conditioner 11, favorable maintenance work can be achieved.

The storage port 35 of the outside casing 34 is closed by the front panel 37. Since the escape edge 65 is formed in the second side wall 36*b* of the outside casing 34 when disposing the first auxiliary refrigerant pipe 58 and the second auxiliary refrigerant pipe 63, it is possible to prevent the front panel 37 from protruding toward the indoor space when disposing the first auxiliary refrigerant pipe 58 and the second auxiliary refrigerant pipe 63. It is possible to prevent the outdoor unit 13 from protruding from the building wall 29 as much as possible. In addition, the design of the front panel 37 can be satisfactorily maintained.

Figure 12:
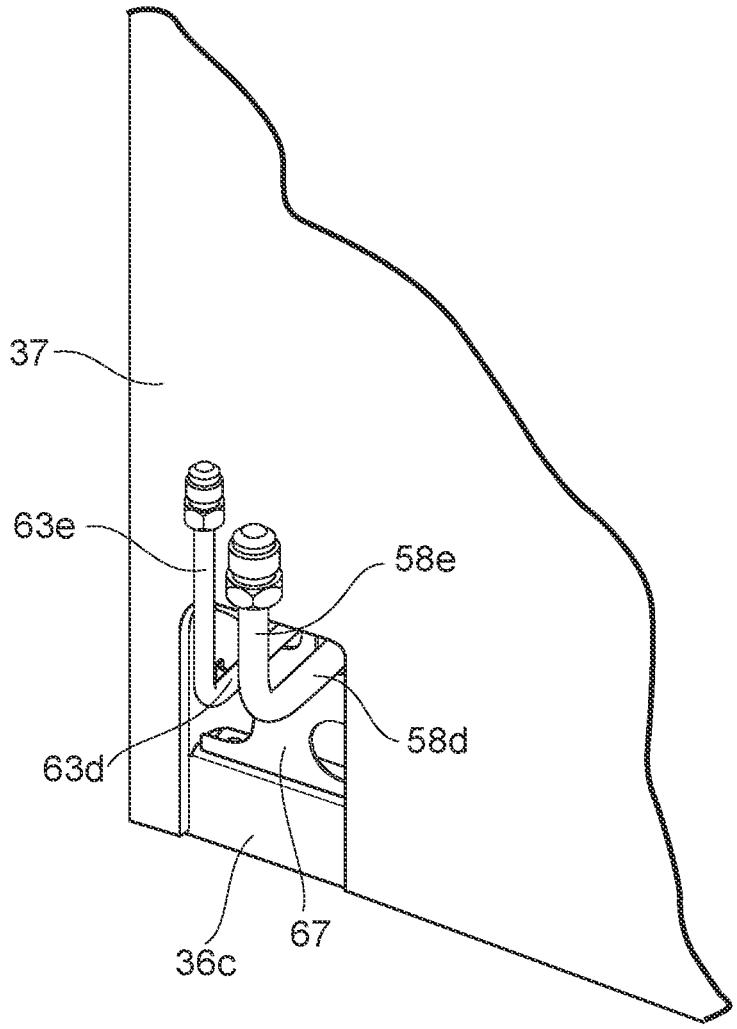
FIG. 12 is a conceptual diagram schematically showing a first auxiliary refrigerant pipe and a second auxiliary refrigerant pipe drawn from a front panel.

As shown in FIG. 12, the first auxiliary refrigerant pipe 58 and the second auxiliary refrigerant pipe 63 may be drawn from the front panel 37. In such a configuration, the outside casing 34 can be completely housed in the opening 31 of the building wall 29. The wall surface of the building wall 29 and the front panel 37 can be set flush with each other. In this way, the outdoor unit 13 can be used for building walls 29 having various wall thicknesses.

Modified Example

When frost (ice) adhered to the outdoor heat exchanger 16 melts by the above-mentioned defrosting operation, for example, defrost-water flows down to the bottom plate 48 of the inside casing 41 due to its own weight. Further, the defrost-water falls from a hole (described below) provided in the bottom plate 48 and flows down to the bottom plate 36*c* of the outside casing 34.

However, when the defrosting operation is switched to the heating operation, cold outside air (e.g., outside air below the freezing point) is sucked into the inside casing 41 again from the open port 33. Then, in the case where the temperature of outside air sucked in the inside casing 41 is below the freezing point, there is a possibility that defrost-water accumulated in the bottom plate 36*c* of the outside casing 34 comes into contact with outside air and the defrost-water freezes. Then, if the defrost-water repeatedly freezes, there is a possibility that the hole provided in the bottom plate 48 is closed by ice and the defrost-water is not drained to the outside casing 34.

Figure 13:
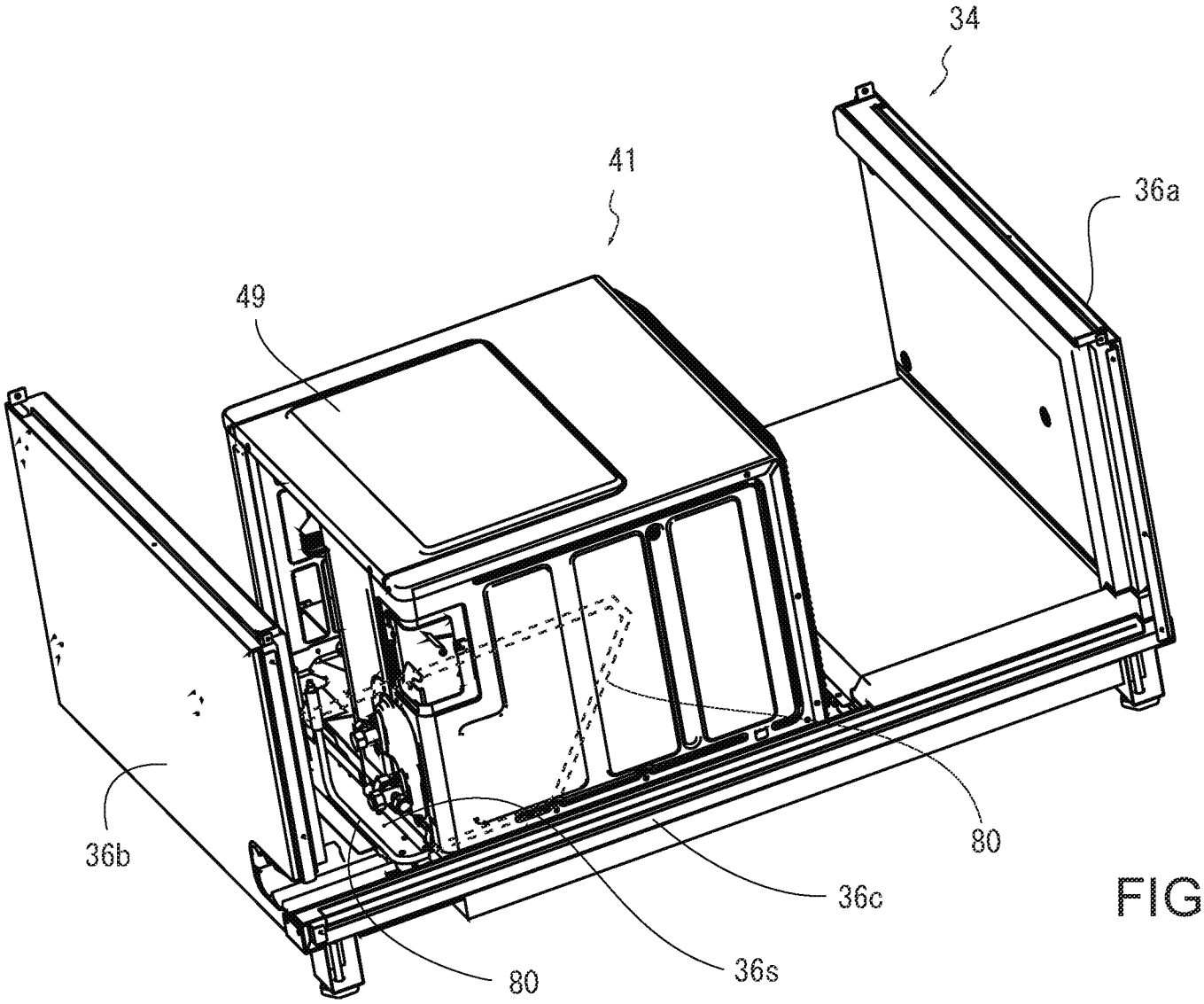
FIG. 13 is a perspective view schematically showing a state where a heater is disposed in the outside casing of the air conditioner.

Therefore, as shown in FIG. 13, in the air conditioner 11, a heater 80 for preventing defrost-water from freezing may be disposed in the outside casing 34. The heater 80 is, for example, a resistance heating type heater. The heater 80 generates Joule heat by energizing a current inside thereof. Further, the heater 80 heats the member therearound.

Figure 14:
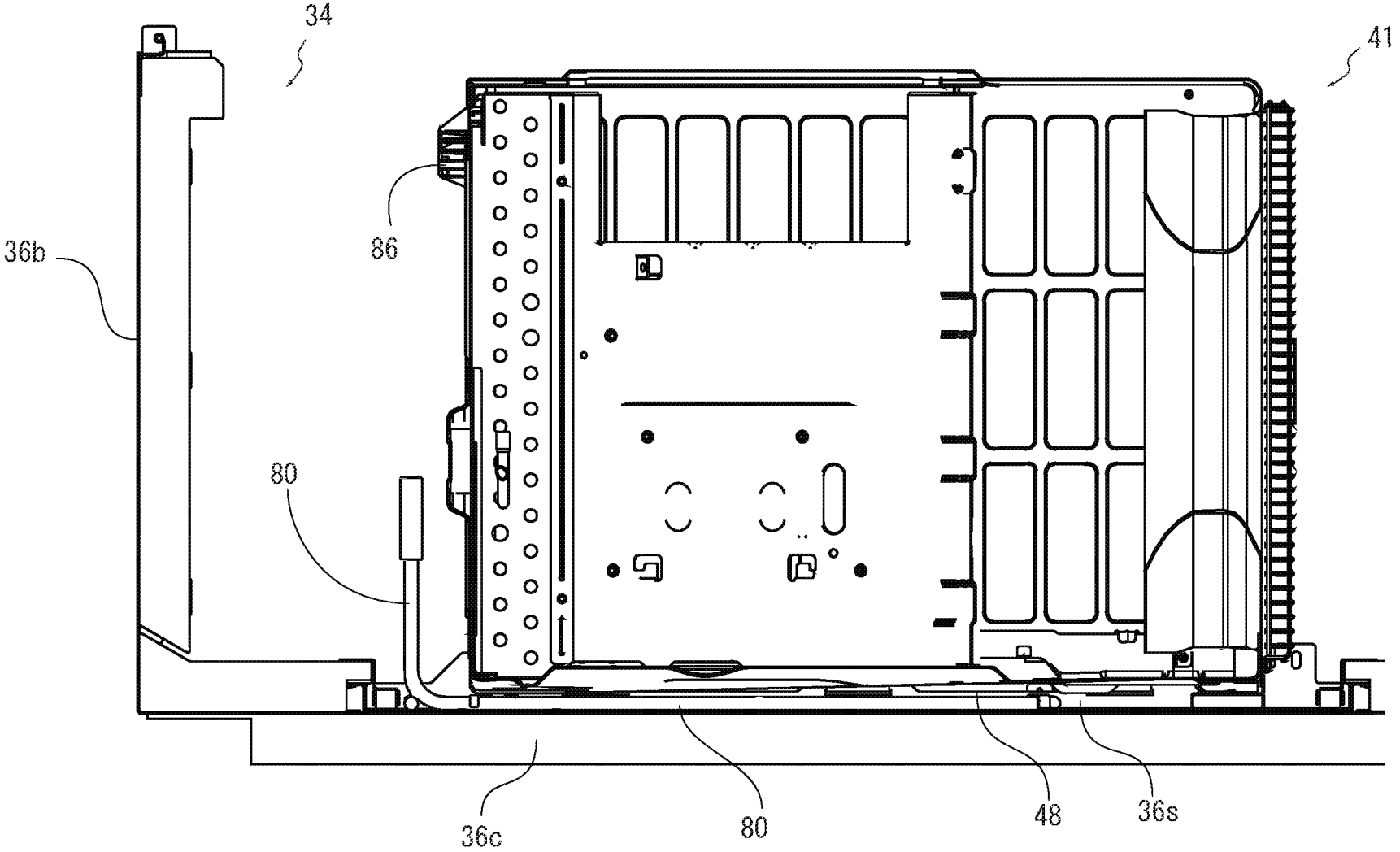
FIG. 14 is a side view schematically showing a state where the heater is disposed between the inside casing and the outside casing.

As shown in FIG. 14, the heater 80 is disposed between the inside casing 41 and the outside casing 34, for example. As a result, it is possible to prevent defrost-water from freezing between the inside casing 41 and the outside casing 34. A defrost-water tray (hereinafter, referred to also as a drain pan 36*s*) is provided between the inside casing 41 and the outside casing 34 (described below). The drain pan 36*s* temporarily stores defrost-water generated when frost adhered to the outdoor heat exchanger 16 of the outdoor unit 13 has melted. The drain pan 36*s* includes a bottom surface 36*s*1 and a side surface 36*s*2 erected from the outer periphery of the bottom surface 36*s*1.

Figure 15:
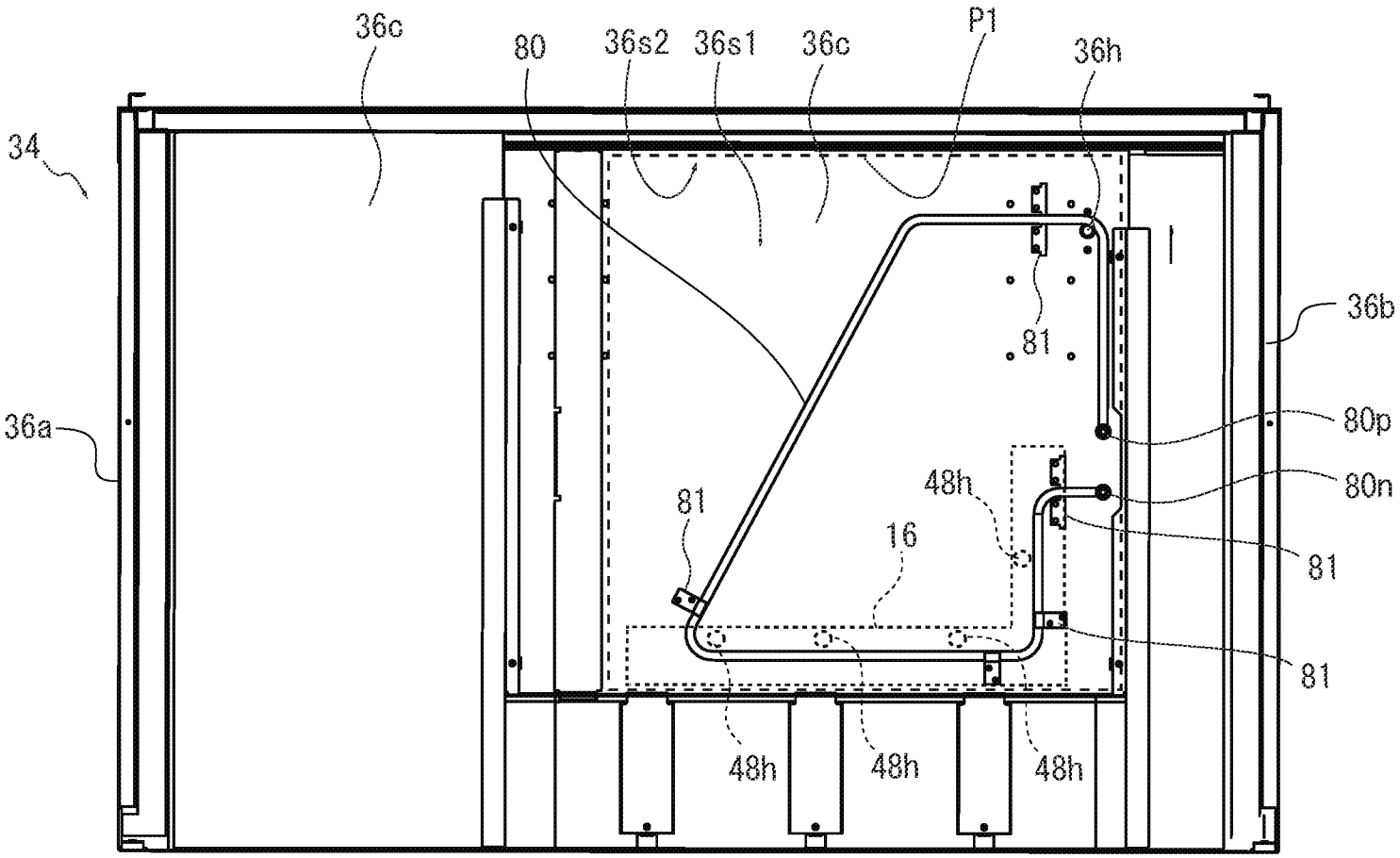
FIG. 15 is a schematic plan view of the outside casing as viewed from the top when the inside casing has been removed.

FIG. 15 shows the plane of the outside casing 34 as viewed from the top when the inside casing 41 has been removed. FIG. 15 shows the outer shape of the outdoor heat exchanger 16 by a broken line, in addition to the outside casing 34. As shown in FIG. 15, the outdoor heat exchanger 16 has an L shape.

The heater 80 forms a loop and is fixed to the bottom surface 36*s*1 by a fixture 81. The heater 80 comes into contact with the bottom surface 36*s*1. A conductive wire (not shown) for supplying electric power to the heater 80 is connected to an end portion 80*p* and an end portion 80*n* that are terminations of the heater 80. The power supply to the heater 80 is controlled by the first control unit 25.

The drain pan 36*s* is provided in a region of the outside casing 34 defined by a broken line P1. The inside casing 41 is disposed above the region defined by the broken line P1. As a result, a certain amount of defrost-water that is generated when frost adhered to the outdoor heat exchanger 16 has melted and drained from the inside casing 41 can be stored in the drain pan 36*s*. Further, at least part of the heater 80 is housed in the drain pan 36*s*. As a result, the heat generated by the heater 80 makes it possible to prevent the defrost-water stored in the drain pan 36*s* from freezing again by outside air.

Further, a drain 36*h* for discharging defrost-water to the outside of the outside casing 34 is provided in each of the bottom surface 36*s*1 and the bottom plate 36*c*. Further, a pump (not shown) such as a drain pump for discharging defrost-water to the outside of the outside casing 34 via the drain 36*h* is provided in the inside casing 41 or the outside casing 34. As a result, the defrost-water collected in the drain pan 36*s* is drained by the pump, thereby preventing defrost-water from overflowing from the drain pan 36*s*. Note that the pump can be operated independently of the operation of the air conditioner 11. As a result, even in the case where rainwater accumulates in the drain pan 36*s* due to a storm or the like while the operation of the air conditioner 11 is stopped, the pump is operated by a float switch mounted on the pump and defrost-water is drained.

Further, a plurality of holes 48*h* shown by broken lines in FIG. 15 shows the outer shapes of a plurality of holes provided in the bottom plate 48 of the inside casing 41 facing the bottom surface 36*s*1 of the drain pan 36*s* in the up and down direction. The plurality of holes 48*h* is located below the outdoor heat exchanger 16. The defrost-water that has flowed down from the outdoor heat exchanger 16 by the defrosting operation falls from the inside casing 41 to the bottom surface 36*s*1 of the drain pan 36*s* via the plurality of holes 48*h*. Further, the plurality of holes 48*h* is arranged side by side in accordance with the outer shape of the outdoor heat exchanger 16 having an L shape. Part of the heater 80 is housed in the drain pan 36*s* so as to be along a direction in which the plurality of holes 48*h* is lined up in the outside casing 34. Further, another part of the heater 80 different from the part is housed in the drain pan 36*s* so as to be adjacent to the drain 36*h* in the outside casing 34. Specifically, the heater 80 includes a straight portion that linearly extends and a plurality of bending portions that bends at an acute angle or an obtuse angle. The straight portion is disposed on the bottom surface 36*s*1 so as to be along a direction in which the holes 48*h* are lined up. Then, one of the bending portions is disposed on the bottom surface 36*s*1 so as to be along the edge of the drain 36*h*. As a result, defrost-water in the plurality of holes 48*h* and the drain 36*h* or around each of the plurality of holes 48*h* and the drain 36*h* is prevented from freezing. Further, defrost-water is guided to the drain 36*h* by the heater 80. Then, it is possible to reliably drain defrost-water to the outside of the outside casing 34 via the plurality of holes 48*h* and the drain 36*h*. Since defrost-water is guided to the drain 36*h* by the heater 80, the defrost-water is prevented from storing in a place away from the heater 80. For this reason, the heater 80 does not need to be heated to a temperature high enough to heat the entire bottom surface 36*s*1 in order to prevent defrost-water from freezing. As a result, it is possible to suppress the increase in electric power to be applied to the heater 80.

The first control unit 25 that controls the heater 80 is provided in, for example, the inside casing 41. The first control unit 25 energizes the heater 80 in the case where the first control unit 25 has received a signal indicating a heating operation (heating operation including a defrosting operation) from the second control unit 26 provided in the indoor unit 12. For example, in the case where a user uses a remote controller (not shown) of the air conditioner 11 to select a heating operation mode of the air conditioner 11, the first control unit 25 receives a signal indicating a heating operation mode from the second control unit 26 and energizes the heater 80. By performing the control of energizing the heater 80 by the first control unit 25 included in the air conditioner 11, it is possible to energize the heater 80 in synchronization with a heating operation.

Also the control of suppressing power consumption of the heater 80 can be performed. For example, the heater 80 may be controlled to start energization in accordance with the outside temperature in the heating operation by the control of the first control unit 25 and may start energization when the outside temperature reaches, for example, 2° C. or less. The outside temperature is detected from the suction air by an outside temperature thermistor 86. By setting the outside temperature for starting energization of the heater 80 to be higher than 0° C., it is possible to prevent defrost-water from freezing even in the case where a measurement error by an outside temperature thermistor occurs. Further, by not raising the outside temperature for starting energization of the heater 80 too much, unnecessary consumption of electric power can be suppressed. Further, the heater 80 is set such that the heater surface temperature is higher than 0° C. even in the case where the outside temperature is −15° C., for example. In this way, even in the case where the outside temperature is extremely reduced, it is possible to prevent defrost-water from freezing.

Figure 16:
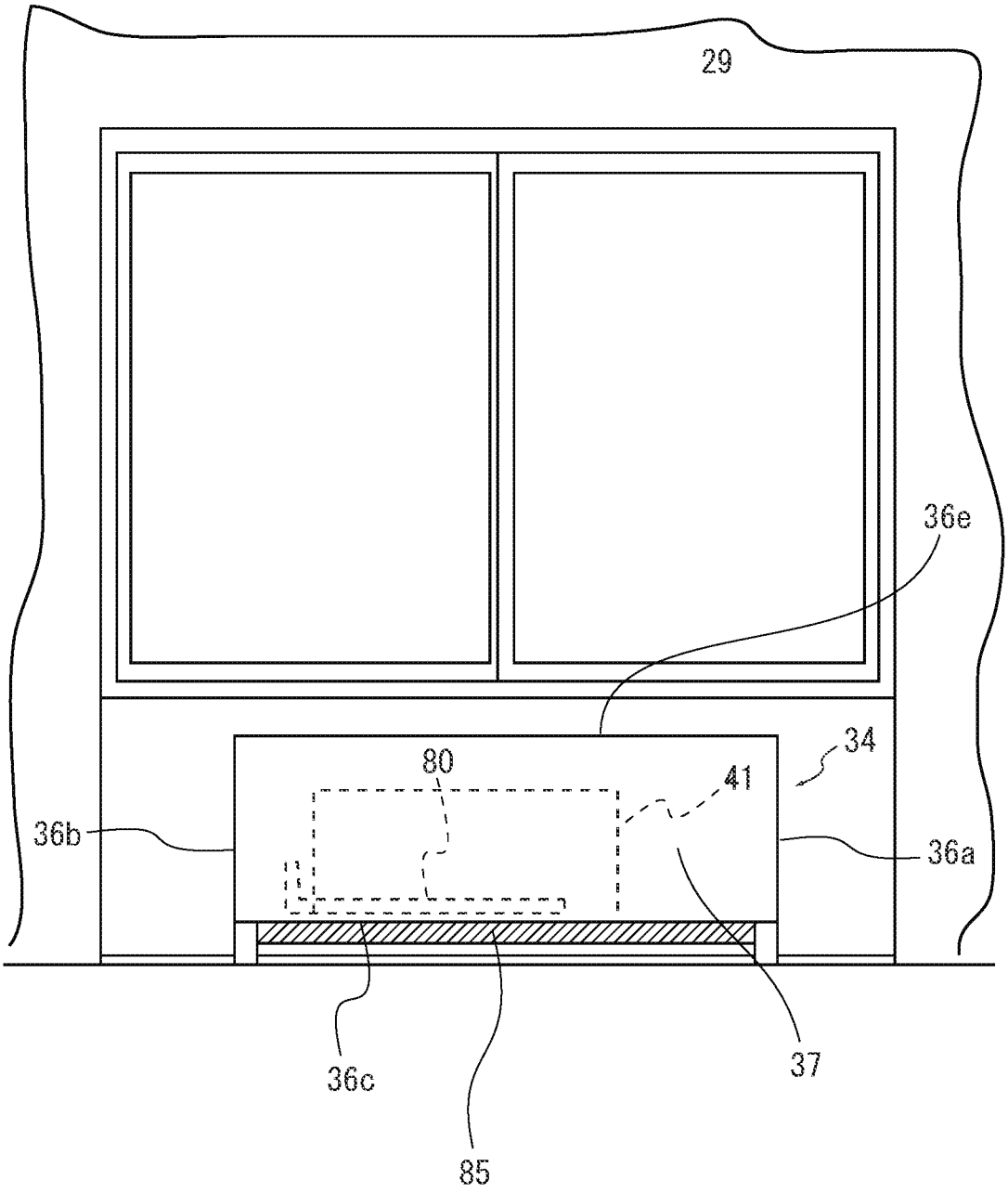
FIG. 16 is a conceptual diagram schematically showing a state where a sound insulation material is disposed on the outside of the outside casing corresponding to a position where the heater is disposed.

Further, also in this modified example, a sound insulation material is disposed on the inner surface of each of the first side wall 36*a*, the second side wall 36*b*, the bottom plate 36*c* (excluding the position where the drain pan 36*s* is provided), the first top wall 36*d*, the second top wall 36*e*, and the front panel 37. In this modified example, as shown in FIG. 16, a sound insulation material 85 is further provided on the outside of the outside casing 34 corresponding to the position where the drain pan 36*s* is disposed. For example, the sound insulation material 85 is disposed below the bottom plate 36*c*. As the material of the sound insulation material 85, foamed polyethylene or the like having excellent sound insulation properties, thermal insulation properties, flexibility, and processability is applied. By disposing the sound insulation material 85 below the bottom plate 36*c*, the sound of the compressor 15 and the sound drainage of defrost-water from the drain pan 36*s* where no sound insulation material is disposed on the inner surface are more reliably prevented from leaking from the inside casing 41 or the outside casing 34 into the room. Further, even in the case where cold outside air is sucked from the open port 33 into the inside casing 41, thermal insulation is performed regarding the temperature of outside air by the thermal insulation properties of the sound insulation material 85 and the indoor temperature is less affected by the outside temperature. Note that the sound insulation material 85 may be provided on the outside of the outside casing 34 corresponding to the position where at least the drain pan 36*s* is disposed.

Although an embodiment of the present invention has been described above, it goes without saying that the present invention is not limited to only the above-mentioned embodiment and various modifications can be made. The respective embodiments are not limited to the independent embodiments and can be combined with each other if technically possible.

REFERENCE SIGNS LIST

11 air conditioner, 12 indoor unit, 13 outdoor unit, 14 indoor heat exchanger, 15 compressor, 15*a* suction pipe, 15*b* discharge pipe, 16 outdoor heat exchanger, 17 expansion valve, 18 four-way valve, 18*a* first port, 18*b* second port, 18*c* third port, 18*d* fourth port, 19 refrigerant circuit (refrigeration circuit), 21 circulation path, 22 circulation path, 22*a* gas pipe, 22*b* liquid pipe, 23 blower fan, 24 blower fan, 25 first control unit, 26 second control unit, 29 building wall, 31 opening, 32 building, 33 open port, 34 outside casing, 35 storage port, 36 wall body, 36*a* side wall (first side wall), 36*b* second side wall, 36*c* bottom plate, 36*d* first top wall, 36*e* second top wall, 36*h* drain, 36*s* drain pan, 36*s*1 bottom surface, 36*s*2 side surface, 37 front panel, 38 grill, 39 internal space (of outside casing), 41 inside casing, 42 blower port, 43 right side plate (first side plate), 44 front plate (second side plate), 45 side plate (third side plate), 46 suction port, 47 fourth side plate, 48 bottom plate, 48*h* hole, 49 top plate, 49*a* opening, 51 suction port, 52 blade, 54 switching valve (first switching valve), 55 switching valve (second switching valve), 58 auxiliary refrigerant pipe (first auxiliary refrigerant pipe), 63 an auxiliary refrigerant pipe (second auxiliary refrigerant pipe), 64 joining edge, 65 escape edge, 66 resin material, 67 bracket, 71 guide plate, 72 vertical wall, 73 stacking piece, 74 regulatory piece, 80 heater, 80*p* end portion, 80*n* end portion, 81 fixture, 85 sound insulation material, 86 outside temperature thermistor, Hb axis line of (connection port), Hr axis line (horizontal axis line) of (screw), Hx axis line of (connection port), Hz axis line (horizontal axis line) of (screw).

The invention claimed is:

1. An air conditioner, characterized by comprising:

an indoor unit that is fixed to a wall surface of an indoor space and houses an indoor heat exchanger; and an outdoor unit that houses an outdoor heat exchanger and a blower fan, the outdoor heat exchanger connected to a refrigerant circuit that includes the indoor heat exchanger, the blower blowing air to the outdoor heat exchanger, the outdoor unit includes an outside casing that is fitted into an opening formed in a building wall and projects from the opening formed in the building wall into a building interior to define an internal space of the outside casing that is arranged in the building interior, wherein the outside casing partitions an outdoor-exposed space and the indoor space, wherein the internal space is open to the outdoor space, the internal space is surrounded by a sound insulation wall, and the internal space is isolated from the indoor space, and an inside casing that is disposed in the internal space and houses the outdoor heat exchanger, the internal space is formed between the outside casing and the inside casing, the outside casing includes: a wall body having a first side wall, a second side wall, a bottom plate, a first top wall, and a second top wall; and a front panel, wherein the first side wall, the second side wall, the bottom plate, the first top wall, the second top wall, and the front panel are each formed as the sound insulation wall, the walls of the wall body extend along respective virtual planes orthogonal to a wall surface of the building wall and define a storage port opening toward the indoor space and an open port being open to the outdoor space through the opening, the front panel is joined to the wall body and closes the storage port, and the inside casing includes a first side plate that faces the first side wall, a second side plate that faces the front panel, a third side plate that faces the second side wall, a fourth side plate that faces the open port, a suction port that is provided in the fourth side plate and is open to the outdoor space, and a blower port that is provided in the first side plate and allows air to be blown out after heat exchange toward the first side wall.

2. The air conditioner according to claim 1, wherein the outside casing includes the second side wall that houses the inside casing between the second side wall and the first side wall, the wall body including the second side wall, and the refrigerant circuit includes a switching valve, the switching valve is connected to the outdoor heat exchanger, protrudes from a side plate facing the second side wall in the inside casing, and switches opening and closing of a connection port on a basis of rotation of a screw whose rotation axis is an axis line set perpendicular to a plate surface of the side plate.

3. The air conditioner according to claim 1, wherein the outside casing includes the wall body and the front panel, the wall body includes the first side wall and the second side wall extending along a virtual plane orthogonal to the wall surface of the building wall and defines the storage port opening toward the indoor space, and the front panel is joined to the wall body and closes the storage port, and the refrigerant circuit includes a switching valve and an auxiliary refrigerant pipe, the switching valve is connected to the outdoor heat exchanger, protrudes from a side plate facing the second side wall in the inside casing, and forms a connection port having an axis line set in parallel to a plate surface of the side plate, and the auxiliary refrigerant pipe is connected to the connection port in accordance with tightening of a flare nut whose rotation axis is the axis line and is drawn from the outside casing to the indoor space on a side of the indoor space than an edge of the second side wall on the side of the indoor space.

4. The air conditioner according to claim 1, wherein the first side wall and the second side wall extend along a virtual plane orthogonal to a wall surface of the building wall, the first top wall extends from an end of the first side wall and the second side wall on sides of the outdoor space toward sides of the indoor space and closes the internal space sandwiched by the first side wall and the second side wall from above, and the second top wall extends from the first top wall toward the sides of the indoor space to ends of the first side wall and the second side wall on the sides of the indoor space and closes the internal space from above so as to be openable and closable.

5. The air conditioner according to claim 1, wherein a heater is disposed between the outside casing and the inside casing.

6. The air conditioner according to claim 1, wherein the outside casing includes a drain pan for storing defrost-water generated when frost adhered to the outdoor heat exchanger is melted, and a pump for discharging the defrost-water to an outside of the outside casing.

7. The air conditioner according to claim 1, wherein a space provided between the blower port and the first side wall is larger than a space provided between the third side plate and the second side wall.

8. The air conditioner according to claim 3, wherein the outside casing includes the bottom plate that is supported so as to be slidable with respect to the wall body in parallel to the first side wall and the second side wall and supports the inside casing from below.

9. The air conditioner according to claim 3, wherein the end of the second side wall on a side of the indoor space includes a joining edge and an escape edge, the joining edge is partitioned in a direction perpendicular to a floor surface and is fitted into the front panel, and the escape edge is recessed from the joining edge toward a side of the outdoor space and accepts entry of the auxiliary refrigerant pipe.

10. The air conditioner according to claim 5, wherein a first controller that controls the heater is provided in the inside casing, and the first controller energizes the heater when a second controller receives a signal indicating a heating operation including a defrosting operation from the second controller provided in the indoor unit.

11. The air conditioner according to claim 5, further comprising the sound insulation material on at least an outside of the outside casing corresponding to a position where the heater is disposed.

12. The air conditioner according to claim 6, wherein at least part of a heater is housed in the drain pan.

13. The air conditioner according to claim 12, wherein a plurality of holes for dropping the defrost-water into the drain pan is provided in a bottom plate of the inside casing, and part of the heater is housed in the drain pan along a direction in which the plurality of holes is lined up.

14. The air conditioner according to claim 10, wherein the heater is controlled by the first controller to start energization in accordance with outside temperature.

15. The air conditioner according to claim 13, wherein a drain for draining the defrost-water to an outside of the outside casing is provided in the drain pan, and another part of the heater different from the part is housed in the drain pan so as to be adjacent to the drain.

* * * * *